US012232545B2

(12) United States Patent
Zeidman

(10) Patent No.: US 12,232,545 B2
(45) **Date of Patent: *Feb. 25, 2025**

(54) SWADDLING SLEEP SACK

(71) Applicant: Hindi R. Zeidman, Upland, CA (US)

(72) Inventor: Hindi R. Zeidman, Upland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/394,619

(22) Filed: Dec. 22, 2023

(65) Prior Publication Data

US 2024/0196996 A1 Jun. 20, 2024

Related U.S. Application Data

(63) Continuation of application No. 17/935,906, filed on Sep. 27, 2022, now Pat. No. 11,903,428.

(60) Provisional application No. 63/251,987, filed on Oct. 4, 2021.

(51) Int. Cl.
*A41B 13/06* (2006.01)

(52) U.S. Cl.
CPC ..... *A41B 13/06* (2013.01); *A41B 2300/322* (2013.01); *A41B 2400/60* (2013.01)

(58) Field of Classification Search
CPC ..... A41D 13/06; A41D 13/1236; A41D 13/1245; A41D 13/1272; A41B 2300/32
See application file for complete search history.

(56) References Cited

U.S. PATENT DOCUMENTS 211,077 A 12/1878 Watson
1,584,853 A 5/1926 Derm
1,964,271 A 6/1934 O'Dwyer
2,307,266 A * 1/1943 Hansen ..... A41B 13/06 2/114
2,429,168 A 10/1947 Padgett
2,469,700 A 5/1949 Pterucelli
2,530,464 A 11/1950 Haman
2,812,516 A 11/1957 Hoffman
2,918,677 A * 12/1959 Pindyck ..... A41B 9/06 2/113
2,989,753 A 6/1961 Burner
3,034,132 A 5/1962 Bernard et al.
(Continued)

FOREIGN PATENT DOCUMENTS

CA 2289901 5/2001
CH 114792 4/1926
(Continued)

OTHER PUBLICATIONS

Aug. 3, 2021, Complaint, *Hindi R. Zeidman v. Freshly Picked, LLC* (1:21-cv-01129-CFC).
(Continued)

*Primary Examiner* — Jillian K Pierorazio
(74) *Attorney, Agent, or Firm* — Knobbe, Martens, Olson & Bear, LLP

(57) ABSTRACT

The sleep sack can include a back panel, a front panel, and a flap. The sleep sack is used by placing the front panel over the back panel. The front panel extends from the shoulder to under the arm of the infant or toddler. The sleep sack is used by placing the flap over the front panel once placed. The flap extends from the shoulder to under the arm of the infant or toddler. The flap can be releasably attached to an outer surface of the sleep sack to adjust the compression of the torso of the infant or toddler.

20 Claims, 6 Drawing Sheets

(56) References Cited

U.S. PATENT DOCUMENTS 3,259,126 A 7/1966 Greiert
4,125,903 A 11/1978 Farrell
4,125,910 A 11/1978 Nicholai
4,172,300 A 10/1979 Miller
4,347,629 A 9/1982 Itoi
4,484,362 A 11/1984 Asher
D282,596 S 2/1986 Bangert
4,688,270 A 8/1987 Denicola et al.
4,759,082 A 7/1988 Mulligan
4,897,885 A 2/1990 Lunt
4,979,250 A 12/1990 Troncone et al.
4,998,296 A 3/1991 Stames
5,062,168 A 11/1991 Kocib
5,611,095 A 3/1997 Schneider
5,722,094 A 3/1998 Ruefer
5,815,833 A 10/1998 Kuo
5,852,827 A * 12/1998 Lear ..... A41B 13/06 2/68
5,924,132 A 7/1999 Wigutow
6,009,576 A 1/2000 Gramme et al.
6,055,686 A 5/2000 Knight
6,145,932 A 11/2000 Hamel-Hyhus et al.
6,243,871 B1 * 6/2001 Fidler ..... A41D 15/002 2/111
D446,907 S 8/2001 Hall et al.
6,415,442 B1 * 7/2002 Smith ..... A41B 13/06 2/69.5
6,450,168 B1 9/2002 Nguyen
6,457,193 B1 10/2002 Li
6,868,566 B2 3/2005 Gatten
D504,753 S 5/2005 Gold et al.
6,928,674 B2 8/2005 Blackburn
D510,792 S 10/2005 Vazquez et al.
6,978,479 B2 12/2005 Thach
7,043,783 B2 5/2006 Gatten
7,076,819 B2 7/2006 Trani et al.
D526,464 S 8/2006 Johnson et al.
7,150,055 B2 12/2006 Wooten, Jr.
7,181,789 B2 2/2007 Gatten
7,246,392 B2 7/2007 Schmid et al.
7,254,849 B1 8/2007 Fiebrich et al.
D557,880 S 12/2007 O'Connor-Cowley
D561,428 S 2/2008 Nilsson
D606,282 S 12/2009 Chen
7,647,658 B2 1/2010 Wilson
7,739,748 B2 6/2010 Nilforushan et al.
7,774,875 B1 8/2010 Zeidman
7,832,032 B2 11/2010 Haislip
D633,278 S 3/2011 de Bourgknecht
D638,204 S * 5/2011 Nilsson ..... D2/864
D643,596 S 8/2011 Ashworth et al.
D650,153 S 12/2011 Chopak et al.
8,191,189 B1 6/2012 Spell
D669,659 S 10/2012 Barski
8,302,225 B1 11/2012 Earnest
D690,904 S 10/2013 Coates
D691,781 S 10/2013 Coates
D696,489 S 12/2013 Dubiski
8,793,813 B2 8/2014 Waters
D716,526 S 11/2014 Harris
8,904,580 B1 12/2014 Christensen et al.
D731,144 S 6/2015 White
RE45,903 E 3/2016 Zeidman
D776,900 S 1/2017 Bopanna et al.
D778,534 S 2/2017 Bopanna et al.
RE46,611 E 11/2017 Zeidman
10,188,150 B2 1/2019 Zeidman
10,188,151 B2 1/2019 Zeidman
10,517,408 B1 * 12/2019 Emerson ..... A41B 13/06
RE47,809 E 1/2020 Zeidman
10,779,579 B2 9/2020 Zeidman
10,779,580 B2 9/2020 Zeidman
RE48,330 E 12/2020 Zeidman
D924,540 S 7/2021 Lynch et al.
D925,864 S 7/2021 Sherer et al.
11,051,560 B2 * 7/2021 Spratt ..... A41D 11/00
D934,534 S 11/2021 Chopak
D951,591 S 5/2022 Chen
D952,291 S 5/2022 Enuganti
RE49,190 E 8/2022 Zeidman
11,470,888 B2 10/2022 Zeidman
D969,453 S 11/2022 Ginsburg
11,903,428 B2 2/2024 Zeidman
11,910,841 B2 2/2024 Zeidman
D1,045,336 S 10/2024 Zeidman
2003/0131411 A1 * 7/2003 Gibson ..... A41B 13/06 2/69.5
2004/0158925 A1 8/2004 Sims
2004/0216230 A1 11/2004 Blackburn
2006/0010600 A1 * 1/2006 Kendy ..... A47D 15/005 5/482
2006/0236441 A1 * 10/2006 Johnson ..... A41B 13/06 2/69.5
2007/0056098 A1 3/2007 Schmid et al.
2007/0136946 A1 6/2007 Haislip
2008/0120774 A1 * 5/2008 Hite ..... A47G 9/0223 5/494
2008/0235848 A1 10/2008 Wilder et al.
2010/0257654 A1 * 10/2010 Waters ..... A41B 13/06 2/69.5
2010/0275373 A1 * 11/2010 Kaplan ..... A41B 13/06 5/494
2011/0179546 A1 7/2011 Millette et al.
2011/0231993 A1 9/2011 Schmid et al.
2012/0023637 A1 2/2012 Neveu
2012/0110716 A1 5/2012 Christensen et al.
2012/0151654 A1 6/2012 Chopak et al.
2012/0284922 A1 * 11/2012 Gangan ..... A41B 13/06 5/494
2012/0311762 A1 * 12/2012 Aiken ..... A41B 13/06 2/69.5
2013/0245414 A1 * 9/2013 Andreoni ..... A41D 13/1281 600/388
2013/0302555 A1 11/2013 Dunn et al.
2013/0333113 A1 * 12/2013 Gotel ..... A41B 13/06 5/494
2014/0033430 A1 * 2/2014 Daugherty ..... A41B 13/06 5/494
2014/0033431 A1 2/2014 Zeidman
2014/0068834 A1 3/2014 Skinner
2014/0298564 A1 10/2014 Miller
2015/0342263 A1 * 12/2015 Taylor ..... A41B 13/06 2/69.5
2016/0165960 A1 6/2016 Jensen et al.
2016/0174619 A1 6/2016 Waters et al.
2016/0295928 A1 * 10/2016 Bopanna ..... A41B 13/06
2017/0049158 A1 * 2/2017 Zeidman ..... A47G 9/083
2017/0181478 A1 6/2017 O'Donnell
2017/0224025 A1 * 8/2017 Villarreal ..... A41B 13/06
2019/0191785 A1 * 6/2019 Vincent ..... A41B 13/06
2019/0208831 A1 7/2019 Joshi
2019/0223515 A1 7/2019 Zeidman
2019/0223516 A1 7/2019 Zeidman
2020/0196685 A1 * 6/2020 Williams ..... A41B 13/06
2020/0237024 A1 7/2020 Glazer
2021/0059318 A1 3/2021 Zeidman
2021/0068472 A1 3/2021 Zeidman
2023/0074593 A1 3/2023 Zeidman
2023/0106389 A1 4/2023 Zeidman
2024/0172810 A1 5/2024 Zeidman
2024/0196996 A1 6/2024 Zeidman

FOREIGN PATENT DOCUMENTS

DE 102010047125 4/2015
DE 102016008165 1/2018
DE 102018105989 9/2019
FR 2967870 6/2012

(56) References Cited

FOREIGN PATENT DOCUMENTS

| | | |
|---|---|---|
| GB | 2466944 | 7/2010 |
| WO | WO 2023/060001 | 4/2023 |

OTHER PUBLICATIONS

International Search Report for PCT/US2022/077118 dated Dec. 15, 2022.

* cited by examiner

SWADDLING SLEEP SACK

CROSS-REFERENCE TO RELATED APPLICATIONS

This application is a continuation of U.S. patent application Ser. No. 17/935,906 filed Sep. 27, 2022, which claims the benefit of U.S. Provisional Application No. 63/251,987, filed Oct. 4, 2021, the entirety of each is hereby incorporated by reference herein.

BACKGROUND

Field

The disclosure generally pertains to the field of sleeping sacks providing compression over the chest of the child replicating the sensation of swaddling.

Description of the Related Art

Archaeological records indicate that infant swaddling was first used around 4000 B.C. in the desert regions of Central Asia in combination with a back-pack cradle board. As time progressed, the migration of people from region to region became a relatively permanent way of life. Swaddling subsequently also became a common part of child-rearing.

Early swaddling used a square piece of cloth. The infant was laid on the cloth diagonally and the corners of the cloth were folded over the feet, body and under the head, and the corners were tied to hold the cloth in position. Swaddling typically formed the clothing for an infant until the infant was about a year old. The confinement provided by the swaddling provided warmth and security for the infant who had recently left the mother's womb.

Even today, swaddling is a standard newborn care practice in most hospitals.

Current infant swaddling makes it easier to swaddle an infant than with traditional square cloths. Nevertheless, a wakeful infant can loosen the swaddling and kick the swaddling off. Accordingly, a need remains for improved swaddling and sleek sacks.

SUMMARY

Infant and toddler sleeping sacks and methods of use are disclosed in various embodiments. The sleeping sack can ease the transition from swaddles. The sleeping sacks can be manufactured for a variety of size ranges. The sleeping sack can include a range for infants ranging from 4 months, 5 months, 6 months, 7 months, 8 months, 9 months, 10 months, 11 months, 12 months, between 4 months and 6 months, between 4 months and 12 months, between 6 months and 12 months, or any range of the foregoing values. The sleeping sack can include a range for toddlers ranging from 12 months, 14 months, 16 months, 18 months, 20 months, 22 months, 24 months, between 12 months and 18 months, between 12 months and 24 months, between 18 months and 24 months, or any range of the foregoing values. The sleeping sack can be designed for infants. The sleeping sack can be designed for toddlers. The sleeping sack can be designed for infants and toddlers. The sleeping sack can be produced in various dimensions to accommodate infants and toddlers of various sizes.

The sleeping sack can be produced from various materials. The material of the sleeping sack can comprise polyester. The material of the sleeping sack can comprise spandex.

The material of the sleeping sack can comprise a polyester spandex blend. The material of the sleeping sack can comprise yarn dyed jersey. The material of the sleeping sack can be made of various colors, such as gender neutral colors of green, gray, yellow, and white, as well as gender identifying colors as blue and pink.

The material of the sleeping sack can comprise a breathable material. The material of the sleeping sack can comprise a moisture wicking material. The material of the sleeping sack can provide rapid moisture wicking capabilities so that the infant does not overheat. The material of the sleeping sack can draw heat and sweat away from the skin of an infant or toddler. The material of the sleeping sack can include fabric fibers which channel moisture along the filament through capillary action, pulling the moisture to the fabric surface to evaporate.

The material of the sleeping sack can comprise a material that does not bunch or gather. The material of the sleeping sack can apply a compressive force on the chest of the infant or toddler, thereby simulating a "womb-like" environment similar to swaddling. The material of the sleeping sack can apply a compressive force imperative for soothing drug-exposed infants and toddlers. The material of the sleeping sack can be cost effective from both a consumer and manufacturer point of view.

Moisture wicking is typically achieved by using one of two methods. The first way to promote moisture wicking is to apply a hydrophilic chemical surface treatment, such as silica, to a fabric. This treatment allows the fabric's fibers to attract water and pull it into the fabric and away from the skin. The second way is to use a knit structure that facilitates capillary action. The first method is referred to herein as chemical wicking, and the second method is referred to herein as mechanical wicking.

Moisture wicking is different from breathability. A breathable fabric, such as cotton, linen, or wool, absorbs moisture and holds the moisture against the skin. For example, highly breathable materials such as 100% cotton can quickly absorb moisture due to perspiration on the infant's skin, but retains the excessive moisture, which does not evaporate quickly from the skin or the fabric. As a result, the infant's skin and the cotton fabric are damp for extended periods of time after the infant perspires, making it uncomfortable for the infant or toddler.

Some fabrics are coated with chemicals that give the fabrics moisture wicking capabilities by allowing the treated fibers to attract or pull moisture away from skin. However, such topologically treated materials tend to lose their wicking capabilities when the chemical coating starts to wear off after repeated washing cycles. The sleeping sack normally undergoes frequent washing for hygiene purposes. Certain embodiments include a non-chemically treated moisture-wicking fabric. Certain embodiments include fabric with both mechanical and chemical wicking properties, which is more desirable than a material that gets its wicking capabilities only from the chemical coating.

In addition, fabrics with good wicking properties, such as polyester blends, tend to have poor stretchability. Poor stretchability can be a problem, as overly rigid material could lead to problems such as hip dysplasia. Certain embodiments include that the material should still be stretchable and allow small movements of an infant or toddler while allowing the material to be maintained in place. Various embodiments provide a material with a mechanical wicking fabric. Certain embodiments include a mechanical wicking fabric that is also stretchable.

Not necessarily all such advantages may be achieved in accordance with any particular embodiment. Thus, the sleek sack may be embodied or carried out in a manner that achieves or optimizes one advantage or group of advantages as taught herein without necessarily achieving other advantages as may be taught or suggested herein.

The sleep sack can have one, some, or all of the following properties. The sleep sack can include a back panel. The back panel can comprise an inner surface and an outer surface. The back panel can comprise an upper end. The upper end can be adjacent to the chest of the infant or toddler. The upper end can be above the hips of the infant or toddler. The back panel can comprise a lower end. The lower end can accommodate the hips of the infant or toddler. The lower end can allow full range of hip movement. The lower end can be shaped to prevent hip dysplasia.

The sleep sack can include a front panel. The front panel can comprise an inner surface and an outer surface. The front panel can comprise an upper end. The upper end can be adjacent to the chest of the infant or toddler. The upper end can be above the hips of the infant or toddler. The front panel can comprise a lower end. The lower end of the back panel and the front panel can be opened and closed. The lower end of the back panel and the front panel can be opened and closed to allow a diaper to be easily removed and replaced. The lower end of the back panel and the front panel can be opened and closed to take a rectal temperature. The lower end of the back panel and the front panel can be opened and closed without changing the chest compression, as described herein.

The back panel and the front panel can form an arm hole. The arm of the infant or toddler can be placed through the arm hole. The back panel can extend along the shoulders of the infant or toddler. The front panel can extend over the shoulder of the infant or toddler. The back panel and the front panel can wrap around the side of the infant or toddler. The back panel and the front panel can wrap around only one shoulder of the infant or toddler. The back panel and the front panel can wrap around the torso of the infant or toddler. The back panel and the front panel can form a one shoulder covering. The back panel and the front panel do not cover the other shoulder. The front panel extends below the other shoulder.

The back panel and the front panel can be reversibly secured. The back panel and the front panel can be integrally formed along one side of the infant or toddler. The back panel and the front panel can be sewn together along one side of the infant or toddler. The back panel and the front panel can be reversibly secured along one side. The back panel and the front panel can be reversibly secured along two sides. The back panel and the front panel can be reversibly secured along the bottom. The back panel and the front panel can be reversibly secured along the bottom and at least one side.

The sleep sack can include a flap. The flap can comprise an inner surface and an outer surface. The flap can comprise an upper end. The upper end can be adjacent to the chest of the infant or toddler. The upper end can be above the hips of the infant or toddler. The flap does not comprise a lower end. The flap covers a portion of the upper end of the front panel. The flap does not cover the lower end of the front panel. The flap is entirely above the lower end of the front panel.

The flap and the front panel can be reversibly secured. The back panel and the flap can be integrally formed along one side of the infant or toddler. The back panel and the flap can be sewn together along one side of the infant or toddler. The flap and the front panel can be reversibly secured along one side. The flap and the front panel can adjust the compression on the torso of the infant or toddler. The flap can secure to the front panel over a range, thereby adjusting the compression.

The back panel and the flap can form an arm hole. The arm of the infant or toddler can be placed through the arm hole. The back panel can extend along the shoulders of the infant or toddler. The flap can extend over the shoulder of the infant or toddler. The back panel and the flap can wrap around the torso or chest of the infant or toddler. The back panel and the flap can wrap around only one shoulder of the infant or toddler. The back panel and the flap can wrap around the torso of the infant or toddler. The back panel and the flap can form a one shoulder covering. The back panel and the flap do not cover the other shoulder. The flap extends below the other shoulder.

The flap and the front panel can include an attachment area. The attachment area can be marked. The attachment area can be under the arm of the infant or toddler. The flap can extend laterally across the torso of the infant or toddler. The flap can extend over one shoulder. The flap can extend to the side of the infant or toddler. The flap can be reversibly secured under the arm of the infant or toddler.

The front panel can extend laterally from the first side of the back panel. The front panel can be folded over the front of the infant or toddler. The flap can extend laterally from the second side of the back panel. The flap can be folded over the front of the infant or toddler. The front panel can have length greater than the flap. The front panel and the flap can have the same or substantially same width. The flap can have a greater width than the front panel. The front panel can be fixed along at least a portion of the first side of the back panel. The front panel can be reversibly secured along a bottom side and the second side of the back panel. The flap can be fixed along at least a portion of the second side of the back panel. The flap can be reversibly secured to the first side of the front panel. The flap can be reversibly secured to the first side of the back panel. The flap can be removably attached to the outer surface. The flap can wrap around the first side.

The sleep sack can have one, some, or all of the following methods of use. The method can comprise placing the back panel against a surface such that the inner surface is facing toward the infant or toddler. The method can comprise placing an infant against the inner surface of the back panel. The method can comprise placing a first arm of the infant or toddler through a first arm hole between the back panel and the front panel. The method can comprise placing a second arm of the infant or toddler through a second arm hole between the back panel and the flap. The method can comprise wrapping the front panel over the front of the infant or toddler. The method can comprise covering only one shoulder with the front panel. The method can comprise covering the shoulder of the first arm with the front panel. The method can comprise securing the front panel and the back panel. The method can comprise sliding a zipper along the lower end of the front panel and the back panel. The method can comprise sliding a zipper along the second side of the front panel and the back panel. The method can comprise wrapping the flap over the front of the infant or toddler. The method can comprise covering only one shoulder with the flap. The method can comprise covering the shoulder of the second arm with the flap. The method can comprise securing the flap. The method can comprise securing the flap to the outer surface of the front panel, the back panel, or the front panel and the back panel. The method can comprises adjusting the compression by tightening the flap.

The flap comprises a laterally extending portion sized to cover only the torso of the infant or toddler. The flap does not extend over the hips of the infant or toddler. The flap can include one or more first attachments near a side of the flap. The first attachments can extend vertically or generally vertically along the edge of the flap. The flap can include one or more second attachments near a top edge of the flap. The second attachments can be angled or offset relative to the first attachments.

The sleep sack, in use, does not cover the head of the infant or toddler. The back panel can extend along the neck or below the neck. The sleep sack can extend over both shoulders. The front panel can extend over one shoulder and the flap can extend over the other shoulder. The upper torso of the infant or toddler can be compressed by the flap. The hips of the infant or toddler can be unconstrained within the lower end of the front panel and the back panel. The lower end can be closable independently of securing the flap. The flap can remain in position while the lower end is opened, for instance for a diaper change.

The sleep sack can include one or more attachment means. The lower end can include a zipper. The zipper can secure the front panel and the back panel along at least one edge. The zipper can be a one-directional zipper. The zipper can be a bi-directional zipper. The lower end can include can be quickly and efficiently opened and closed. The sleep sack can include hook and loop fasteners. The flap can be secured to the outer surface with hook and loop fasteners. The sleep sack can be secured around the infant or toddler.

The sleep sack can include a back panel configured to open to lay flat. The back panel can comprise an outward-facing surface that, when an infant or toddler is placed on the back panel, faces away from the infant or toddler. The back panel can comprise an inner-facing surface that, when the infant or toddler is placed on the back panel, faces toward the infant or toddler. The back panel can comprise an upper portion with an upper edge that, when in use, is near the nape of the neck of the infant or toddler. The back panel comprises a lower portion spaced apart from the upper portion that, when in use, is proximal the hip and feet of the infant or toddler. The sleep sack can include a laterally extending front panel integral with the upper portion of the back panel. The laterally extending front panel can be integral with lower portion of the back panel. The front panel comprising one or more attachments extending along the edge of the lower portion. The front panel comprising one or more attachments extending along the edge of the upper portion. The front panel and the back panel are recloseable. The sleep sack can include a laterally extending flap integral with the upper portion of the back panel. The flap comprising one or more attachments extending along the edge of the flap.

The sleep sacks can comprise any of the foregoing embodiments and also can include constructions of the following examples.

BRIEF DESCRIPTION OF THE DRAWINGS

Example embodiments that implement the various features of the disclosed swaddling and associated methods will now be described with reference to the drawings. The drawings and associated descriptions are provided to illustrate embodiments and not to limit the scope of the disclosure.

Throughout the drawings, reference numbers are frequently reused to indicate correspondence between referenced (or similar) elements. Nevertheless, the use of different numbers to indicate certain elements does not necessarily indicate that these elements are dissimilar or do not correspond with each other.

DETAILED DESCRIPTION OF THE PREFERRED EMBODIMENT

The following detailed description discloses sleep sack and corresponding methods of use. It should be appreciated that the embodiments discussed below represent examples of suitable configurations, and the components can be resized and/or reconfigured as desired to produce a desired embodiment or effect. For example, the figures may show certain features on a left side or a right side of the swaddling. These features can be reversed so that features are placed on the opposite side of the swaddling. Such modifications are within the scope of the invention.

As used herein, and unless otherwise indicated, the term "panel" and "flap" are broad terms and are to be given its ordinary and customary meaning to a person of ordinary skill in the art (that is, it is not to be limited to a special or customized meaning). As used herein, and unless otherwise indicated, the term "lower" refers to a location that, in use, is nearer to the feet, hips, or rear of an infant or toddler. As used herein, and unless otherwise indicated, the term "upper" refers to a location that, in use, is nearer to the head, neck, or torso of an infant or toddler. As used herein, and unless otherwise indicated, the term "front" refers to a location that, in use, is the anterior or ventral portion of the body. As used herein, and unless otherwise indicated, the term "back" refers to a location that, in use, is the posterior portion of the body.

Figure 1:
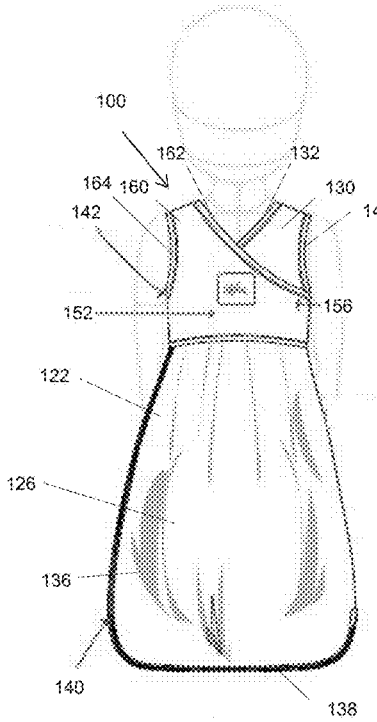
FIG. 1 is a front view of a sleep sack.
Figure 2:
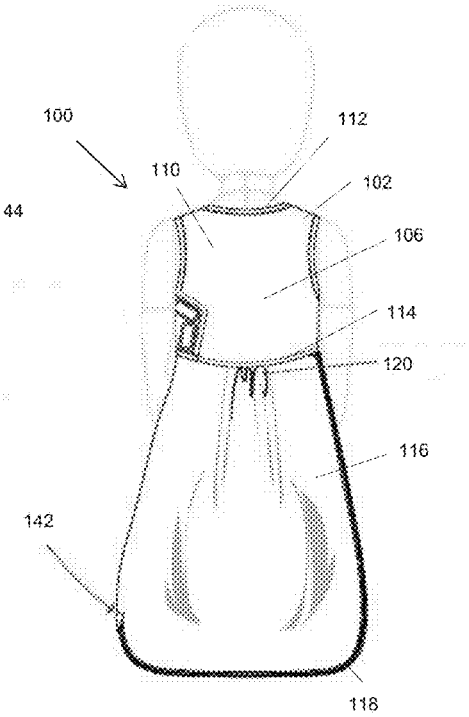
FIG. 2 is a back view of the sleep sack of FIG. 1.
Figure 3:
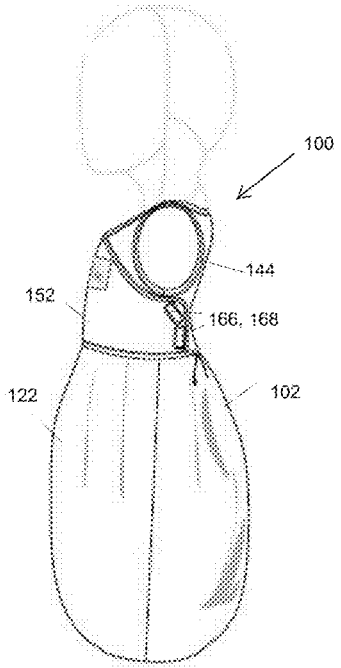
FIG. 3 is a first side view of the sleep sack of FIG. 1.
Figure 4:
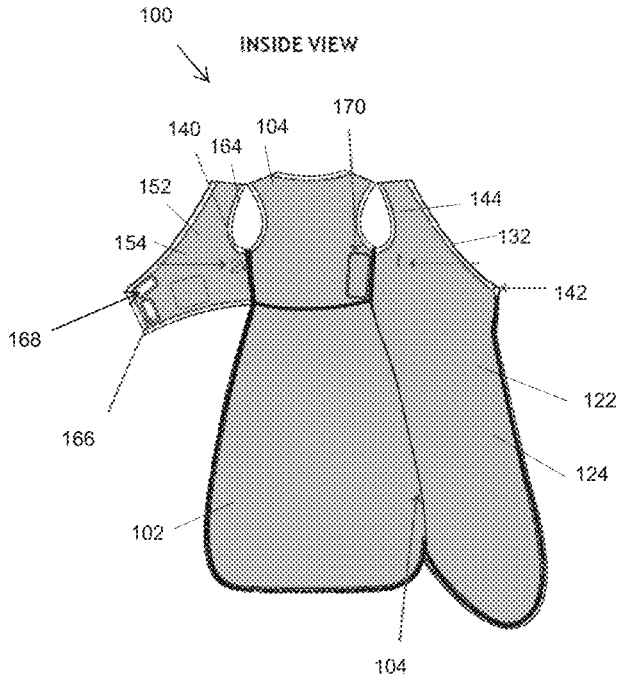
FIG. 4 is an inside view in a method of use of the sleep sack of FIG. 1.

FIG. 1 illustrates a front view of a sleep sack 100. FIG. 2 illustrates a back view of the sleep sack 100. FIG. 3 illustrates a first side view of the sleep sack 100. FIG. 4 illustrates an inside side view of the sleep sack 100. The sleep sack 100 is designed to maintain compression on an upper portion or torso of an infant or toddler. The compression can ease the transition from swaddling. The sleep sack 100 is designed mimic the compression experienced by swaddling while allowing movement of the hips for older infants and toddlers. The sleep sack 100 is designed decrease irritability while promoting self-soothing. The sleep sack 100 is designed to encourage calming. The sleep sack 100 is designed to enhance quality of sleep to improve rest and cycle regulations. The sleep sack 100 is designed to have several therapeutic benefits. While not to be limited by a theory, the compression of the chest can mimic a "womb-like" environment, thereby promoting calmness before a sleep cycle.

The sleep sack 100 is designed to promote infant safe sleep practices. The sleep sack 100 is designed to extend under the chin of the infant or toddler. The sleep sack 100 is designed to be safer than a blanket. The sleep sack 100 is designed keep the infant or toddler covered as they move or roll in sleep. The sleep sack 100 is designed to keep material away from the mouth or nose of the infant or toddler.

The sleep sack 100 is designed with moisture-wicking fabric. The material reduces the risk of overheating. The material can move moisture away from the skin of the infant or toddler. The moisture can move to an outer surface of the sleep sack. The moisture can evaporate from the outer surface. The capillary action of the fabric can move moisture. The material can include a TOG rating between 0.3 and 3.0. The material can include a TOG rating of 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, or any range of two of the foregoing values. The material can be ideal for year round use. The material can maintain a temperature of 21-23 degrees Celsius or 69-73 degrees Fahrenheit.

The sleep sack 100 is designed with hook and loop fasteners, or Velcro®. The hook and loop fasteners can be tightened similar to a swaddle. The infant or toddler gets that hugged feelings that they are accustomed to from infant swaddles. The sleep sack 100 is designed so that the fit can be individualized to meet the needs and size of the infant or toddler. The sleep sack 100 is adjustable to accommodate the torso of the infant or toddler as the infant or toddler grows. The sleep sack 100 is designed to allow access for diaper changes via an opening at the bottom of the sleep sack 100. The sleep sack 100 is designed that as the infant or toddler grows, the bottom can be left open for standing and ease of movement.

The sleep sack 100 can include a back panel 102. The back panel 102 can comprise an inner surface 104 as shown in FIG. 4. The inner surface 104 can face toward the infant or toddler, in use. The back panel 102 can comprise an outer surface 106. The outer surface 106 can face away from the infant or toddler, in use. The moisture-wicking material can move moisture from the inner surface 104 to the outer surface 106.

The back panel 102 can comprise an upper portion 110. The upper portion 110 can include an upper edge 112. The upper edge 112 can extend along the nape of the neck. The upper edge 112 can be horizontal or generally horizontal. The upper edge 112 can have a slight inward curve. The upper portion 110 can be near the upper back or torso of the infant or toddler. The upper portion 110 can be adjacent to the chest of the infant or toddler. The upper portion 110 can be above the waist of the infant or toddler. The upper portion 110 can be above the hips of the infant or toddler. The upper portion 110 can include a lower seam 114. The lower seam 114 can be an empire seam. The lower seam 114 can be over edge edgestitch. The lower seam 114 can include a chain stitch.

The back panel 102 can comprise a lower portion 116. The lower portion 116 can be near the hips or legs of the infant or toddler. The lower portion 116 can extend below the waist of the infant or toddler. The lower portion 116 can accommodate motion of the hips and legs of the infant or toddler. The lower portion 116 can allow full range of hip movement. The lower portion 116 can be shaped to prevent hip dysplasia.

The back panel 102 can include a closable edge 118. The closable edge 118 can be along the upper portion 110, or a section thereof. The closable edge 118 can be along the lower portion 116, or a section thereof. The closable edge 118 can be continuous, for instance in for the use of a zipper. In other embodiments, the closable edge 118 can be discontinuous. The closable edge 118 can extend below the feet of the infant or toddler. The closable edge 118 can be along the lower edge of the lower portion 116. The closable edge 118 can be along a segment of a side of the lower portion 116. The closable edge 118 can be along a segment of both sides of the lower portion 116. The closable edge 118 can be along different lengths of both sides of the lower portion 116. The closable edge 118 can be along the same or similar lengths of both sides of the lower portion 116. The closable edge 118 can be along the upper portion 110. The closable edge 118 can be along the upper portion 110 to an arm hole, as described herein. The closable edge 118 can be along the side of the infant or toddler. The closable edge 118 can be along both sides of the infant or toddler. The closable edge 118 can be along the feet of the infant or toddler.

The back panel 102 can include gathers 120. The gathers 120 an accommodate motion of the hips and legs of the infant or toddler. The gathers 120 can allow more circumferential fabric for the lower portion 116 than the upper portion 110. The gathers 120 can include one or more sections of gathers. The gathers 120 can include 1 inch of fabric, 2 inches of fabric, 3 inches of fabric, 4 inches of fabric, 5 inches of fabric, 6 inches of fabric, 7 inches of fabric, 8 inches of fabric, between 2 inches and 4 inches of fabric, between 4 inches and 6 inches of fabric, or any range of two of the foregoing values.

The sleep sack 100 can include a front panel 122. The front panel 122 can comprise an inner surface 124 as shown in FIG. 4. The inner surface 124 can face toward the infant or toddler, in use. The front panel 122 can comprise an outer surface 126. The outer surface 126 can face away from the infant or toddler, in use. The moisture-wicking material can move moisture from the inner surface 124 to the outer surface 126.

The front panel 122 can comprise an upper portion 130. The upper portion 130 can include an upper edge 132. The upper edge 132 can extend across the torso. The upper edge 132 can be diagonal. The upper edge 132 can taper downward. The upper portion 130 can be near the upper front or torso of the infant or toddler. The upper portion 130 can be adjacent to the chest of the infant or toddler. The upper portion 130 can be above the waist of the infant or toddler. The upper portion 130 can be above the hips of the infant or toddler.

The front panel 122 can comprise a lower portion 136. The lower portion 136 can be near the hips or legs of the infant or toddler. The lower portion 136 can extend below the waist of the infant or toddler. The lower portion 136 can accommodate motion of the hips and legs of the infant or toddler. The lower portion 136 can allow full range of hip movement. The lower portion 136 can be shaped to prevent hip dysplasia. The upper portion 130 and the lower portion 136 can be continuous, without a seam. The upper portion 130 and the lower portion 136 can be integrally formed.

The front panel 122 can include a closable edge 138. The closable edge 138 can be along the upper portion 130, or a section thereof. The closable edge 138 can be along the lower portion 136, or a section thereof. The closable edge 138 can be continuous, for instance in for the use of a zipper. In other embodiments, the closable edge 138 can be discontinuous. The closable edge 138 can extend below the feet of the infant or toddler. The closable edge 138 can be along the lower edge of the lower portion 136. The closable edge 138 can be along a segment of a side of the lower portion 136. The closable edge 138 can be along a segment of both sides of the lower portion 136. The closable edge 138 can be along different lengths of both sides of the lower portion 136. The closable edge 138 can be along the same or similar lengths of both sides of the lower portion 136. The closable edge 138 can be along the upper portion 130. The closable edge 138 can be along the upper portion 130 to an arm hole. The closable edge 138 can be along the side of the infant or toddler. The closable edge 138 can be along both sides of the infant or toddler. The closable edge 138 can be along the feet of the infant or toddler.

The upper portion 130 of the front panel 122 and the upper portion 110 of the back panel 102 can be continuous, without a seam. The upper portion 130 of the front panel 122 and the upper portion 110 of the back panel 102 can be integrally formed. The lower portion 136 of the front panel 122 and the lower portion 116 of the back panel 102 can be continuous, without a seam. The lower portion 136 of the front panel 122 and the lower portion 116 of the back panel 102 can be integrally formed.

The front panel 122 and the back panel 102 can be reversibly secured. The front panel 122 and the back panel 102 can be reversibly secured by hook and loop fasteners, male and female detents, buttons, zippers, strings, ties, and equivalents thereof. The front panel 122 and the back panel 102 can be reversibly secured by a zipper 140. The zipper 140 can secure the closable edge 138 of the front panel 122 and the closable edge 118 of the back panel 102. The zipper 140 can be a two-way zip closure. The zipper 140 can be a one-way zip closure. The zipper 140 can be provided for ease of changing a diaper.

The sleep sack 100 can include one or more zipper garage 142. The closable edges 118, 138 can extend from the zipper garage 142. The upper portion 130 of the front panel 122 can include the zipper garage 142. The upper portion 110 of the back panel 102 can include the zipper garage 142. The lower portion 136 of the front panel 122 can include the zipper garage 142. The lower portion 116 of the back panel 102 can include the zipper garage 142. The sleep sack 100 can include two zipper garages 142, one zipper garage 142 at each end of the zipper 140. The zipper garage 142 can be formed from a single layer, folded over to front. The zipper garage 142 can be sewn in place. The zipper garage 142 can include a fabric housing for the zipper pull tab. The zipper garage 142 holds the zipper pull tab in place. The zipper garage 142 provides a buffer between the zipper pull tab and the infant or toddler, preventing irritation to the skin.

The closable edges 118, 138 can form a J-shape. The closable edges 118, 138 can form a U-shape. The closable edges 118, 138 can form an L-shape. The closable edges 118, 138 can form an I-shape. The closable edges 118, 138 extend along a lower edge of the sleep sack 100, or a section thereof. The closable edges 118, 138 extend along a first side of the sleep sack 100, or a section thereof. The closable edges 118, 138 extend a percentage of the first side for instance 5%, 10%, 15%, 20%, 25%, 30%, 35%, 40%, or any range of two of the foregoing values. The closable edges 118, 138 extend along a second side of the sleep sack 100, or a section thereof. The closable edges 118, 138 extend a percentage of the second side for instance 50%, 55%, 60%, 65%, 70%, 75%, 80%, 85%, 90%, or any range of two of the foregoing values. The closable edges 118, 138 can extend along a greater portion of one side than other side.

The back panel 102 and the front panel 122 can form an arm hole 144. The arm of the infant or toddler can be placed through the arm hole 144. The upper portion 110 of the back panel 102 can extend along the shoulders of the infant or toddler. The upper portion 130 of the front panel 122 can extend over the shoulder of the infant or toddler. The upper portion 110 of the back panel 102 and the upper portion 130 of the front panel 122 can include a shoulder seam. The upper portion 130 of the front panel 122 can be attached the top near the arm hole 140.

The back panel 102 and the front panel 122 can be folded around the side of the infant or toddler. The back panel 102 and the front panel 102 can cover only one shoulder of the infant or toddler. The front panel 122 can be folded over the back panel 102. The front panel 122 can substantially cover the infant or toddler. The upper portion 130 crosses diagonally over the torso of the infant or toddler. The upper edge 132 can be diagonal over the chest. The upper edge 132 extends from the shoulder of the first arm to under the second arm. The upper edge 132 forms a one shoulder wrap. The back panel 102 and the front panel 122 do not cover both shoulders. The front panel 122 extends below one shoulder.

The back panel 102 and the front panel 122 can be reversibly secured with the zipper 140 once the front panel 122 is folded over the back panel 102. The back panel 102 and the front panel 122 can be reversibly secured along the closable edges 118, 138. The back panel 102 and the front panel 122 can be reversibly secured along a free edge of the front panel 122. The back panel 102 and the front panel 122 can be reversibly secured along the lower portions 116, 136. The back panel 102 and the front panel 122 can be reversibly secured along the upper portions 110, 130. The back panel 102 and the front panel 122 can be reversibly secured along the bottom. The back panel 102 and the front panel 122 can be reversibly secured along the bottom and at least one side.

The sleep sack 100 can include a flap 152. The flap 152 can comprise an inner surface 154 as shown in FIG. 4. The inner surface 154 can face toward the infant or toddler, in use. The flap 152 can comprise an outer surface 156. The outer surface 156 can face away from the infant or toddler, in use. The moisture-wicking material can move moisture from the inner surface 154 to the outer surface 156.

The flap 152 can comprise an upper portion 160. The upper portion 160 can include an upper edge 162. The upper edge 162 can extend across the torso. The upper edge 162 can be diagonal. The upper edge 162 can taper downward. The upper portion 160 can be near the upper front or torso of the infant or toddler. The upper portion 160 can be adjacent to the chest of the infant or toddler. The upper portion 160 can be above the waist of the infant or toddler. The upper portion 160 can be above the hips of the infant or toddler.

The back panel 102 and the flap 152 can form an arm hole 164. The arm of the infant or toddler can be placed through the arm hole 164. The upper portion 110 of the back panel 102 can extend along the shoulders of the infant or toddler. The upper portion 160 of the flap 152 can extend over the shoulder of the infant or toddler. The upper portion 110 of the back panel 102 and the upper portion 160 of the flap 152 can include a shoulder seam. The upper portion 160 of the flap 152 can be attached the top near the arm hole 164.

The flap 152 does not comprise a lower portion. The flap 152 can be designed to cover only a portion of the chest or torso. The flap 152 does not cover the hips or legs of the infant or toddler. The flap 152 does not extend below the waist of the infant or toddler. The flap 152 does not extend over the hips. The flap 152 does not extend over the legs. The flap 152 does not limit motion of the hips and legs of the infant or toddler. The flap 152 does not affect the full range of hip movement. The flap 152 can be adjacent to the chest of the infant or toddler. The flap 152 can be above the hips of the infant or toddler. The flap 152 covers a portion of the upper portion 130 of the front panel 122. The flap 152 does not cover the lower portion 136 of the front panel 122. The flap 152 is entirely above the lower portion 136 of the front panel 122.

The upper portion 160 of the flap 152 aligns with the upper portion 130 of the front panel 122. The upper portion 160 of the flap 152 substantially overlaps with the upper portion 130 of the front panel 122. The upper portion 160 of the flap 152 aligns with the upper portion 110 of the back panel 102. The upper portion 160 of the flap 152 substantially overlaps with the upper portion 110 of the back panel 102. The flap 152 can extend over a percentage of the length of the second side for instance 30%, 35%, 40%, 45% 50%, 55%, 60%, or any range of two of the foregoing values.

The upper portion 160 of the flap 152 and the upper portion 130 of the front panel 122 form a cross-over pattern. The upper portion 160 of the flap 152 covers one shoulder and the upper portion 130 of the front panel 122 covers another shoulder. The upper portion 130 of the front panel 122 extends diagonally across the upper portion 110 of the back panel 102. The upper portion 160 of the flap 152 extends diagonally across the upper portion 130 of the front panel 122.

The back panel 102 and the flap 152 can be folded around the side of the infant or toddler. The back panel 102 and the flap 152 can cover only one shoulder of the infant or toddler. The flap 152 can be folded over the back panel 102. The flap 152 can be folded over the front panel 122. The flap 152 can substantially cover a portion of the torso of the infant or toddler. The flap 152 crosses diagonally over the torso of the infant or toddler. The upper edge 162 is diagonal over the chest. The upper edge 162 extends from the shoulder of the second arm to under the first arm. The upper edge 162 forms a one shoulder wrap. The back panel 102 and the flap 152 do not cover both shoulders. The flap 152 extends below one shoulder.

The upper portion 160 of the flap 152 and the upper portion 110 of the back panel 102 can be continuous, without a seam. The upper portion 160 of the flap 152 and the upper portion 110 of the back panel 102 can be integrally formed. The flap 152 and the back panel 102 can be reversibly secured. The flap 152 and the back panel 102 can be reversibly secured by hook and loop fasteners, male and female detents, buttons, zippers, strings, ties, and equivalents thereof. The flap 152 and the front panel 122 can be reversibly secured. The flap 152 and the front panel 122 can be reversibly secured by hook and loop fasteners, male and female detents, buttons, zippers, strings, ties, and equivalents thereof.

The flap 152 can include one or more tabs 166, 168 of hook and loop fasteners. The flap 152 can include a first tab 166. The first tab 166 can be vertically or generally vertically oriented. The flap 152 can include a second tab 168. The first tab 166 can be horizontally or generally horizontally oriented. The first tab 166 and the second tab 168 can be skewed or non-parallel. The first tab 166 and the second tab 168 offset. The first tab 166 and the second tab 168 can be oriented to account for different pull-off forces. The first tab 166 can counteract forces in a first direction. The second tab 168 can counteract forces in a second direction, wherein the first direction and the second direction are different. The first tab 166 can be rectangular. The second tab 168 can be rectangular. The first tab 166 can be square. The second tab 168 can be square. The first tab 166 can be circular. The second tab 168 can be circular. The first tab 166 can be polygonal. The second tab 168 can be polygonal. The first tab 166 and the second tab 168 can have the same shape. The first tab 166 and the second tab 168 can have different shapes.

The back panel 102 can include one or more complementary tabs 170. The front panel 122 can include one or more complementary tabs 170. The complementary tab 170 can extend between the front panel 122 and the back panel 102. The complementary tab 170 can have a greater length than the first tab 166. The complementary tab 170 can have a greater width than the first tab 166. The complementary tab 170 can have a greater surface area than the first tab 166. The complementary tab 170 can have a greater length than the second tab 168. The complementary tab 170 can have a greater width than the second tab 168. The complementary tab 170 can have a greater surface area than the second tab 168. The first tab 166 can be secured to the complementary tab 170. The second tab 168 can be secured to the complementary tab 170. The complementary tab 170 can be shaped and sized to allow the first tab 166 to be secured at any of a variety of locations on the larger complementary tab 170. The complementary tab 170 can be shaped and sized to allow the second tab 168 to be secured at any of a variety of locations on the larger complementary tab 170. The complementary tab 170 can be shaped and sized to accommodate different compression levels. The complementary tab 170 can be shaped and sized to accommodate growth of the infant or toddler. The complementary tab 170 can be shaped and sized to accommodate variations in chest dimensions of infants or toddlers.

The first tab 166 and the second tab 168 can include one or more tabs of hook fabric. Therefore, the complementary tab 170 can include one or more tabs of loop fabric. The first tab 166 and the second tab 168 can include one or more tabs of loop fabric. Therefore, the complementary tab 170 can include one or more tabs of hook fabric. However, a variety of suitable means for attachment can be used. For example, the first tab 166, the second tab 168, and the complementary tab 170 can comprise one or more of the following elements: loop fabric (plural rounds or tabs, a single strip, or other suitable configurations), hook fabric (plural rounds or tabs, a single strip, or other suitable configurations), one or more male halves of a snap fastener, one or more female halves of a snap fastener, a half of a zipper, one or more buttons, one or more button holes or rings, one or more strings, one or more ties, and equivalents thereof.

The flap 152 can be reversibly secured. The flap 152 can be reversibly secured along one side of the infant or toddle. The flap 152 can adjust the compression on the torso of the infant or toddler. The flap 152 can be secured over a range, thereby adjusting the compression.

The sleep sack 100 can be appropriately sized for different infants and toddlers. The sleep sack 100 can be appropriately sized for infants and toddlers 4 months to 6 months, 6 months to 9 months, 9 months to 12 months, 4 months to 12 months, 6 months to 12 months, 12 months to 18 months, 18 months to 24 months, 12 months to 24 months, or any range of two of the foregoing values. The sleep sack 100 can be made of a variety of materials. Desirably, the materials are selected to be soft, durable, hypoallergenic, and/or easily launderable with a standard washing machine and dryer. Example materials for can include polyester and spandex.

The length of the flap 152, as measured from the shoulder seam, is less than the length of the front panel 122 as measured from the shoulder seam. The width of the flap 152, as measured from the side seam with the back panel 102 can be greater than the width of the front panel 122 as measured from the side seam with the back panel 102. The width of the flap 152, as measured from the side seam with the back panel 102 can be approximately the same than the width of the front panel 122 as measured from the side seam with the back panel 102.

The flap 152 and front panel 122 can be configured in several different shapes. In a first example shape, as shown in FIG. 1, the upper edge 132 of the front panel 122 and the upper edge 162 of the flap 152 are angled downward from the shoulder seams, each in opposite directions. The lower edge the flap 152 can be horizontal or generally horizontal. The upper portion 130 of the front panel 122 and the upper portion 160 of the flap 152 can terminate at outer edge, which is vertical or substantially vertical.

The sleep sack 100 is dimensioned to allow the infant or toddler to be placed into the sleep sack 100, with the arms located externally. The sleep sack 100 can include the arm holes 144, 164. The arms can be positioned outside of the sleep sack 100. The arms can be free to allow the infant or toddler to effectively turn over or move during sleep. The sleep sack 100 can be appropriately sized for different infant or toddler uses. Smaller sleep sacks 100 can be used with infants. Larger sleep sacks 100 can be used with larger infants or toddlers.

The sleep sack 100 can be made of a variety of suitable materials. Desirably, the sleep sack 100 is made of a resilient soft material that maintains a comfortable pressure on the infant or toddler placed into the sleep sack 100. Desirably, the materials are selected to be soft, durable, hypoallergenic, and/or easily launderable with a standard washing machine and dryer. The sleep sack 100 can comprises polyester and spandex. The sleep sack 100 can comprise moisture wicking material, which can reduce excess heat and thus the possibility of the infant or toddler overheating.

Figure 5:
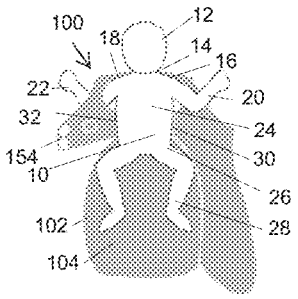
FIG. 5 is a first view in a method of use of the sleep sack of FIG. 1.
Figure 6:
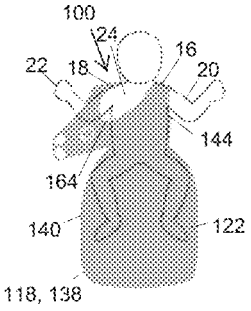
FIG. 6 is a second view in a method of use of the sleep sack of FIG. 1.
Figure 7:
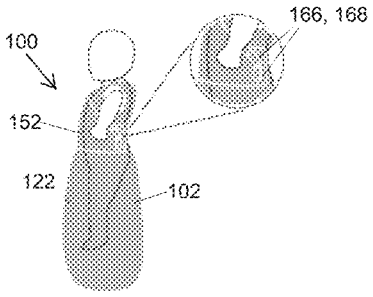
FIG. 7 is a third view in a method of use of the sleep sack of FIG. 1.
Figure 8:
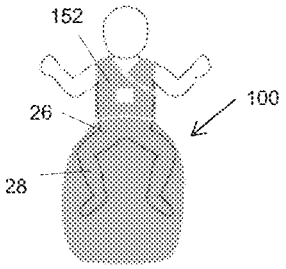
FIG. 8 is a fourth view in a method of use of the sleep sack of FIG. 1.

FIG. 5 illustrates a first view in a method of use of the sleep sack 100. FIG. 6 illustrates a second view in a method of use of the sleep sack 100. FIG. 7 illustrates a third view in a method of use of the sleep sack. FIG. 8 illustrates a fourth view in a method of use of the sleep sack.

The method can comprise placing the back panel 102 against a surface such that the inner surface is facing toward the infant or toddler. The infant or toddler 10 has a head 12, a neck 14, a first shoulder 16, a second shoulder 18, a first arm 20, and a second arm 22. The infant or toddler 10 has a torso 24, hips 26, and legs 28. The first arm 20 can be a left arm of the infant or toddler 10 as illustrated. The second arm 22 can be a right arm of the infant or toddler 10 as illustrated. The infant or toddler 10 has a front or anterior portion of the body. The infant or toddler 10 has a back or posterior portion of the body. The infant or toddler 10 has a first side 30 of the body. The first side 30 can include the first shoulder 16 and the first arm 20. The first side can be a left side of the infant or toddler 10. The infant or toddler 10 has a second side 32 of the body. The second side 32 can include the second shoulder 18 and the second arm 22. The second side 32 can be a right side.

The infant or toddler 10 is positioned relative to the back panel 102. The back of the infant or toddler 10 is positioned at the top of the sleep sack 100. The torso 24 of the infant or toddler 10 is near the upper portion 130 of the back panel 102. The upper portion 110 can include the upper edge 112. The upper edge 112 can extend along the nape of the neck 14. The upper edge 112 can be horizontal or generally horizontal. The head 12 can be entirely above the upper edge 112. The upper edge 112 can extend along the first shoulder 16 and the second shoulder 18. The infant or toddler 10 can be approximately centered along a conceptual vertical centerline of the back panel 102.

The posterior portion of the body of the infant or toddler 10 is against the inner surface 104. The back panel 102 can comprise the inner surface 104 that can face toward the infant or toddler, in use. The back panel 102 can comprise the outer surface 106 that can face away from the infant or toddler, in use. The back panel 102 can be flat or substantially flat. The method can comprise placing the infant or toddler 10 against the inner surface 104 of the back panel 102. In other embodiments, such as for toddlers, the back panel 102 need not be flat. The infant or toddler 10 can be upright or standing. The back panel 102 can be placed against the posterior portion of the body of the infant or toddler. The back panel 102 can be positioned like a robe or other garment relative to the infant or toddler 10.

The method can comprise placing the first arm 20 of the infant or toddler 10 through the first arm hole 144. The first arm hole 144 can be between the back panel 102 and the front panel 122. The first arm 20 can be the left arm. The method can comprise placing the left arm of the infant or toddler 10 through the first arm hole 144. The back panel 102 can be flat or substantially flat. The method can comprise placing the first arm 20 of the infant or toddler 10 through the first arm hole 144 while the infant or toddler is on their back. In other embodiments, the infant or toddler 10 can be upright or standing. The back panel 102 can be against the posterior portion of the body of the infant or toddler 10 and the first arm 20 can be positioned through the first arm hole 144. The first arm 20 can be positioned through the first arm hole 144 similar to other garments for the infant or toddler 10.

The first arm 20 can extend through the first arm hole 144. The upper arm, the elbow, the lower arm, and the hand of the first arm 20 of the infant or toddler 10 can be outside of the sleep sack 100. The back panel 102 and the front panel 122 can include a shoulder seam. The shoulder seam can be positioned over the first shoulder 16 of the infant or toddler 10. The shoulder seam can be positioned over the shoulder of the first arm 20. The first arm 20 can be external to the sleep sack 100. The first arm 20 is not constrained by a pocket or pouch of the sleep sack 100. The first arm 20, below the first shoulder 16, is completely outside of the sleep sack 100.

The method can comprise placing the second arm 22 of the infant or toddler 10 through the second arm hole 164. The second arm hole 164 can be between the back panel 102 and the flap 152. The second arm 22 can be the right arm. The method can comprise placing the right arm of the infant or toddler 10 through the second arm hole 164. The back panel 102 can be flat or substantially flat. The method can comprise placing the second arm 22 of the infant or toddler 10 through the second arm hole 164 while the infant or toddler is on their back. In other embodiments, the infant or toddler 10 can be upright or standing. The back panel 102 can be against the posterior portion of the body of the infant or toddler 10 and the second arm 22 can be positioned through the second arm hole 164. The second arm 22 can be positioned through the second arm hole 164 similar to other garments for the infant or toddler 10.

The second arm 22 can extend through the second arm hole 164. The upper arm, the elbow, the lower arm, and the hand of the second arm 22 of the infant or toddler 10 can be outside of the sleep sack 100. The back panel 102 and the flap 152 can include a shoulder seam. The shoulder seam can be positioned over the second shoulder 28 of the infant or toddler 10. The shoulder seam can be positioned over the shoulder of the second arm 22. The second arm 22 can be external to the sleep sack 100. The second arm 22 is not constrained by a pocket or pouch of the sleep sack 100. The second arm 22, below the shoulder, is completely outside of the sleep sack 100.

The first arm 20 and the second arm 22 can be positioned through the arm holes 144, 164 in any order. In some methods, the first arm 20 is positioned through the first arm hole 144 first. In some methods, the second arm 22 is positioned through the second arm hole 164 first. The method can include placing the top of the infant or toddler's back at the top of the sleep sack. The method can include gently placing the arms through adjacent arm holes 144, 164. These and other steps are shown in FIG. 5.

The method can comprise wrapping the front panel 122 over the front of the infant or toddler 10. The front panel 122 can be folded over the infant or toddler 10. The front panel 122 can be folded over the back panel 102. The front panel 122 and the back panel 102 can have the same or similar shapes along at least a portion of the length. The front panel 122 and the back panel 102 can be have the same or similar lower portion. The lower portion 136 of the front panel 122 can overlie the lower portion 116 of the back panel 102. The lower portion 136 of the front panel 122 can be a mirror image of the lower portion 116 of the back panel 102. The lower portion 136 of the front panel 122 can be the same or substantially similar to the lower portion 116 of the back panel 102.

The lower portion 136 of the front panel 122 and the lower portion 116 of the back panel 102 can mate. The lower portion 136 of the front panel 122 and the lower portion 116 of the back panel 102 can match in outline. The lower portion 136 of the front panel 122 and the lower portion 116 of the back panel 102 can have the same or similar outside edge. The lower portion 136 of the front panel 122 and the lower portion 116 of the back panel 102 can align the closable edges 118, 138 along the lower portions 116, 136.

The front panel 122 and the back panel 102 can have the different shapes along at least a portion of the length. The front panel 122 and the back panel 102 can have the different shapes for the upper portions 110, 130. The upper portion 130 of the front panel 122 can overlie the upper portion 110 of the back panel 102. The upper portion 130 of the front panel 122 can be a partially overlap of the upper portion 110 of the back panel 102. The upper portion 130 of the front panel 122 can be less than to the upper portion 110 of the back panel 102.

The upper portion 130 of the front panel 122 and the upper portion 110 of the back panel 102 can mate. The upper portion 130 of the front panel 122 and the upper portion 110 of the back panel 102 can align along a portion of an edge. The upper portion 130 of the front panel 122 and the upper portion 110 of the back panel 102 can have the same or similar outside edge. The upper portion 130 of the front panel 122 and the upper portion 110 of the back panel 102 can align the closable edges 118, 138 along the upper portions 110, 130.

The front panel 122 and the back panel 122 can be sewn along the first side 30 of the infant or toddler 10. The front panel 122 and the back panel 122 can be continuous or integral along the first side 30. The front panel 122 can fold over the back panel 122 along the first side 30. The first side 30 can include a portion of the closeable edge 118, 138. The closeable edge 118, 138 can extend up a portion of the length of the first side 30.

The closeable edge 118, 138 can extend along the bottom edge of the lower portions 116, 136. The closeable edge 118, 138 can close the entire lateral aspect of the lower portions 116, 136. The entire bottom edge can include the closeable edge 118, 138.

The front panel 122 and the back panel 122 can include the closeable edge along the second side 32 of the infant or toddler 10. The front panel 122 and the back panel 122 can be selectively opened or closed along the second side 32. The front panel 122 can be releasably secured to back panel 122 along the second side 32. The second side 32 can include a portion of the closeable edge 118, 138. The closeable edge 118, 138 can extend up a portion of the length of the second side 32. The closeable edge 118, 138 can extend to the second arm hole 164.

The zipper 140 can slide along the closable edges 118, 138. The zipper 140 can be a two way zipper. The zipper 140 can slide from the second arm hole 164, along the second side 32, below the legs 28, and along the first side 30. The zipper 140 can be tucked into the zipper garage 142 near the first side 30. The zipper 140 can slide from the first side 30, below the legs 28, along the second side 32, and to second arm hole 164. The zipper 140 can be tucked into the zipper garage 142 near the second arm hole 164. The zipper 140 can slide along the closable edge 118, 138. The closeable edge 118, 138 extends along a greater length along the second side 32 than the first side 30.

The method can comprise covering only one shoulder with the front panel 122. The method can comprise covering the shoulder 18 of the first arm 20 with the front panel 122. The front panel 122 is secured to the back panel 102 along the closable edges 118, 138. The front panel 122 forms a one-shoulder design. The front panel 122 extends over the torso 24 of the infant or toddler 10. The front panel 122 extends diagonally across the torso 24 of the infant or toddler 10. The front panel 122 extends from the first shoulder 16. The front panel 122 extends under the second arm 20. The front panel 122 extends under the second arm hole 164. The front panel 122 can be releaseably secured under the second arm hole 164.

In some embodiments, the front panel 122 applies a compressive force. The front panel 122 can snuggly contact with the torso 24 of the infant or toddler 10. The front panel 122 can be stretched against the torso 24. In some embodiments, the front panel 122 does not apply a compressive force. The front panel 122 can loosely contact with the torso 24 of the infant or toddler 10. The front panel 122 can rest against the torso. The front panel 122 may not be in contact with the torso 24 of the infant or toddler 10.

The method can comprise securing the front panel 122 and the back panel 102. The method can comprise sliding the zipper along 140 the lower end of the front panel 122 and the back panel 102. The method can comprise sliding the zipper 140 along a large portion of the second side 32 of the infant or toddler 10. The method can comprise sliding the zipper 140 along a small portion of the first side 30 of the infant or toddler 10. The method can include folding the right side over. The method can include pulling the zipper slider from the lower right hand to the upper left hand. The method can include tucking the zipper 140 completely into the fabric hood of the zipper garage 14. These and other methods steps are shown in FIG. 6.

The method can comprise wrapping the flap 152 over the front of the infant or toddler 10. The flap 152 can be folded over the infant or toddler 10. The flap 152 can be folded over the front panel 122. The flap 152 can be folded over the back panel 102.

The flap 152 and the front panel 122 can have the same or similar shapes along at least a portion of the length. The flap 152 and the upper portion 130 of the front panel 122 can have the same or similar shape. The flap 152 and the upper portion 130 of the front panel 122 can be a mirror image shape. The flap 152 and the upper portion 130 of the front panel 122 can have different shapes. The flap 152 can extend from the back panel 102 along the second side 32 of the infant or toddler 10. The front panel 122 can extend from the back panel 102 along the first side 30 of the infant or toddler 10. The flap 152 can overlie the upper portion 130 of the front panel 122 after the front panel 122 is secured along the closeable edge 118, 138. The flap 152 can overlie the upper portion 130 of the front panel 122 after the front panel 122 wrapped around the front of the infant or toddler 10.

The method can comprise covering only one shoulder with the flap 152. The method can comprise covering the shoulder 18 of the second arm 22 with the flap 152. The flap 152 can be secured to the back panel 102 with the first tab 166, the second tab 168, and the complementary tab 170. The flap 152 can be secured to the front panel 122 with the first tab 166, the second tab 168, and the complementary tab 170. The flap 152 forms a one-shoulder design. The flap 152 extends over the torso 24 of the infant or toddler 10. The flap 152 extends diagonally across the torso 24 of the infant or toddler 10. The flap 152 extends from the second shoulder 18. The flap 152 extends under the first arm 20. The flap 152 extends under the first arm hole 144. The flap 152 can be releaseably secured under the first arm hole 144.

The flap 152 can be secured to an outer surface of the sleep sack 100. In some embodiments, the flap 152 is secured to the outer surface 106 of the back panel 102. In some embodiments, the flap 152 is secured to the outer surface 126 of the front panel 122. The flap 152 can be secured by a different means that securing the first panel 122 and the back panel 102. The flap 152 can be secured by attaching hook and loop fabric.

The inner surface 154 of the flap 152 can include the first tab 166. The inner surface 154 of the flap 152 can include the second tab 168. The inner surface 154 of the flap 152 can include any number of tabs. The inner surface 154 of the flap 152 can include any orientation of tabs. The outer surface 106 of the sleep sack 100 can include the complementary tab 170. The complementary tab 170 can be located on the outer surface 104 of the back panel 102. The complementary tab 170 can be located on the outer surface 124 of the front panel 122. The outer surface of the sleep sack 100 can include any number of tabs. The outer surface of the sleep sack 100 can include any orientation of tabs. The first tab 166, the second tab 168, and the complementary tab 170 can comprise hook and loop fasteners.

The flap 152 is secured to the back panel 102 with the first tab 166, the second tab 168, and the complementary tab 170. The flap 152 is secured to the front panel 122 with the first tab 166, the second tab 168, and the complementary tab 170. The flap 152 forms a one-shoulder design. The flap 152 extends over the torso 24 of the infant or toddler 10. The flap 152 extends diagonally across the torso 24 of the infant or toddler 10. The flap 152 extends from the second shoulder 18. The flap 152 extends under the first arm 20. The flap 152 extends under the first arm hole 144. The flap 152 can be releaseably secured under the first arm hole 144.

The flap 152 applies a compressive force. The flap 152 can snuggly contact with the torso 24 of the infant or toddler 10. The flap 152 can be stretched against the torso 24. The flap 152 can be pulled from the second side 32 to the first side 30 of the infant or toddler 10. The flap 152 can apply compression depending on the placement of the first tab 166, the second tab 168, and the complementary tab 170. The flap 152, the first tab 166, and the second tab 168 can be at a first position on the complementary tab 170 to apply a slight compressive force on the torso 24 of the infant or toddler 10. The flap 152, the first tab 166, and the second tab 168 can be at a second position on the complementary tab 170 to apply a medium compressive force on the torso 24 of the infant or toddler 10. The flap 152, the first tab 166, and the second tab 168 can be at a third position on the complementary tab 170 to apply a strong compressive force on the torso 24 of the infant or toddler 10. The first position, the second position, and the third position can be laterally aligned along the complementary tab 170. The complementary tab 170 can have a large surface area to accommodate different position of the first tab 166 and the second tab 168. In some embodiments, the first tab 166 is hook fabric and the second tab 168 is hook fabric. The complementary tab 170 can be loop fabric. The flap 152 can be positioned so that the hook fabric is placed on loop fabric, and not the material of the sleep sack 100.

The method can comprise securing the flap 152. The method can comprise securing the flap 152 to the outer surface of the front panel 122, the back panel 102, or the front panel 122 and the back panel 102. The method can comprises adjusting the compression by tightening the flap 152. The method can comprises adjusting the compression by loosening the flap 152. The method can include folding the left side flap over to connect entire hook and loop fastener. The method can include ensuring the hook is placed on the loop, not on the fabric. These and other steps are shown in FIG. 7.

The flap 152 creates a snug fit around the torso 24 of the infant or toddler 10. The flap 152 does not overlie the hips 26 or legs 28 of the infant or toddler 10. The flap 24 is above the hips 26 and legs 28. The flap 152 applies a compressive force only to the torso 24. The flap 152 applies a compressive force only to chest of the infant or toddler 10. The flap 152 does not apply a compressive force to the arms 20, 22. The flap 152 does not apply a compressive force to the lower body. The sleep sack 100 provides targeted compression only to the torso 24. The sleep sack 100 allows the arms 20, 22 to extend outside of the sleep sack 100. The inventive cross-over design allows compression to be selectively applied.

The sleep sack 100 allows a loose fit around the hips 26 and the legs 28. The lower portion 116 of the back panel 102 and the lower portion 136 of the front panel 122 form a loose covering for the hips 26 and legs 28. The lower portion 116 of the back panel 102 and the lower portion 136 of the front panel 122 allow a full range of movement. The lower portion 116 of the back panel 102 and the lower portion 136 of the front panel 122 can reduce or prevent hip dysplasia. The method can include creating a snug fit with around the torso with the hook and loop fastener. The method can include allowing for loose fit around the hip joint area. These and other steps are shown in FIG. 8.

In some methods, the closeable edge 118, 138 can be opened along the first side 30. The closeable edge 118, 138 can be opened below the legs 28 of the infant or toddler 10. The closeable edge 118, 138 can opened to allow the infant or toddler 10 to stand while within the sleep sack 100. The closeable edge 118, 138 can be opened below the legs 28 of the infant or toddler 10 to allow diaper changes. The closeable edge 118, 138 can be opened to take a rectal temperature. The closeable edge 118, 138 can be opened while the flap 152 is secured. The closeable edge 118, 138 can be opened without releasing the compression from the flap 152. The closeable edge 118, 138 can be independently opened and closed from the flap 152. The closeable edge 118, 138 can be independently opened and closed without changing or releasing the compression.

The closeable edges 118, 138 and the flap 152 are separately secured. In some methods, the closeable edges 118, 138 can be secured first. In some methods, the flap 152 is secured first. The method can be performed in any order.

In the illustrated embodiment, the front panel 122 is near the first side 30 of the infant or toddler 10. The first arm 20 is placed through the first arm hole 144. The first arm 20 can be right arm of the infant or toddler 10 and the first side 30 can be the right side of the infant or toddler 10. In the illustrated embodiment, the flap 152 is near the second side 32 of the infant or toddler 10. The second arm 22 is placed through the second arm hole 164. The second arm 22 can be left arm of the infant or toddler 10 and the second side 32 can be the left side of the infant or toddler 10.

The sleep sack 100 can be manufactured with a different structure. The flap 152 can be near the first side 30 of the infant or toddler 10. The front panel 122 can be near the second side 32 of the infant or toddler 10. It should be appreciated that the embodiments represent examples of suitable configurations, and the components can be resized and/or reconfigured as desired to produce a desired embodiment or effect. For example, the figures may show certain features on a left side or a right side of the infant or toddler 10. These features can be reversed in certain embodiments so that features are placed on the opposite side of the sleep sack 100.

The method can include folding the front panel 122 over the back panel 102. The front panel 122 can be wrapped before the flap 152 is wrapped. The front panel 122 commences from the back panel 102 on the first side 30. The front panel 122 can be wrapped toward the second side 32. In certain configurations, means for removably attaching the closeable edges 118, 138 can provide a secure but easily removable connection between the front panel 122 and the back panel 102. Suitable means for removable attachment include the zipper 140 and other attachment means described herein. The flap 152 commences from the back panel 102 on the second side 32. Next, the flap 152 is wrapped around the front panel 102 and toward the first side 30. In certain configurations, means for removably attaching the flap 152 to the outer surface of the sleep sack 100 can provide a secure but easily removable connection for the flap 152. Suitable means for removable attachment include hook and loop fasteners and other attachment means described herein.

The sleep sack 100 can be made of a resilient soft material that maintains a comfortable pressure on the infant or toddler 10. Desirably, the material is selected to be soft, durable, hypoallergenic, and/or easily launderable with a standard washing machine and dryer. Example materials for can include a polyester spandex blend.

The sleep sack 100 can be advantageous because the configuration allows the flap 152 to be adjusted to accommodate growth and to accommodate different sized infants and toddlers. The tabs of hook and loop fabric 166, 168 allows adjustment of the flap 152 in the lateral direction. The tabs of hook and loop fabric 166, 168 allows adjustment of the flap 152 in the vertical direction. After the front panel 122 is secured to the back panel 102, the tabs 166, 168 will face the complementary tab 170 once folded over the torso 24 of the infant or toddler 10. Certain embodiments include the complementary tab 170 having a larger surface area to improve the adjustability of the flap 152. The example embodiment comprises two tabs 166, 168 and one complementary tab 170, but other configurations are contemplated.

The configuration of the sleep sack 100 can advantageously reduce movement of the sleep sack 100 in the area near the infant or toddler's neck and thereby reduce the possibility of unsafe bunching of the sleep sack 100 around the infant or toddler's neck or mouth. The over shoulder design can prevent migration of the sleep sack 100. The compression of the flap 152 around the torso 24 can prevent migration of the sleep sack 100. The over shoulder design can be a sleeveless design. The sleep sack 100 comprises arm holes 144, 164 through which the arms 20, 22 of the infant or toddler 10 are placed. The flap 152 is sized so that it does not necessarily wrap multiple times around the infant or toddler 10. Rather, the flap 152 extends from the second side 32 toward the first side 30. The flap 152 can extend partially around the first side 30 of the infant or toddler 10.

The upper portion 130 of the front panel 122 includes a first sloped section. The first sloped section crosses the torso 24 from the first side 30 to the second side 32. The upper portion 160 of the flap 152 includes a second sloped section. The second sloped section crosses the torso 24 from the second side 32 to the first side 30. The front panel 122 and the flap 152 create an inventive cross-over pattern. At least one tab 168 is positioned along the second sloped section of the flap 152.

The upper portion 130 of the front panel 122 includes a first vertical or substantially vertical section. The vertical or substantially vertical section covers the torso 24 from the first side 30 to the second side 32 below the arm holes 144, 164. The upper portion 160 of the flap 152 includes a second vertical or substantially vertical section. The second vertical or substantially vertical section crosses the torso 24 from the second side 32 to the first side 30 below the arm holes 144, 146. The front panel 122 and the flap 152 create an inventive cross-over pattern. At least one tab 166 is positioned along the second vertical or substantially vertical section of the flap 152.

The flap 152 can include more tabs 166, 168 than the outside surface of the sleep sack 100. The ratio of tabs on the flap 152 to complementary tabs can be 1:1, 2:1, 3:1, 4:1, 5:1, 6:1, or any range of the following values. The sleep sack include one or more junctions. The junctions can include rounded edges or corners. The junctions can include smooth transitions between portions of the flap 152. The junctions can include smooth transitions between portions of the front panel 122.

In various embodiments, the maximum lateral length of a member of the complementary tabs is at least 2 (or at least about 2), at least 3 (or at least about 3), at least 4 (or at least about 4), or at least 5 (or at least about 5) times longer than the maximum lateral length of a member of the tabs of the flap 152. For example, the maximum lateral length of a member of the complementary tabs can be 6 in (or about 6 in) (15 cm (or about 15 cm)). The maximum lateral length of a member of the tabs of the flap 152 can be 1.5 in (or about 1.5 in) (3.75 cm (or about 3.75 cm)).

The maximum vertical length of a member of the complementary tabs can be at least 1.25 (or at least about 1.25), at least 1.5 (or at least about 1.5), at least 2 (or at least about 2), or at least 3 (or at least about 3) times longer than the maximum vertical length of a member of the tabs of the flap 152. For example, the maximum vertical length of a member of the complementary tabs can be 3 in (or about 3 in) (7.5 cm (or about 7.5 cm)). The maximum vertical length of a member of the tabs of the flap 152 can be 1.5 in (or about 1.5 in) (3.75 cm (or about 3.75 cm)).

The surface area of a member of the complementary tabs can be at least 6 times (or at least about 6 times), at least 8 times (or at least about 8 times), at least 10 times (or at least about 10 times), or at least 12 times (or at least about 12 times) larger than the surface area of a member of the tabs of the flap 152. For example, the surface area of a member of the complementary tabs can be 18 $in^2$ (or about 18 $in^2$) (116 $cm^2$ (or about 116 $cm^2$)). The surface area of a member of the tabs of the flap 152 can be 1.77 $in^2$ (or about 1.77 $in^2$) (11.4 $cm^2$ (or about 11.4 $cm^2$)). The foregoing dimensions are provided as examples of suitable configurations. Other dimensions are possible and are within the scope of the disclosure.

The configuration can be advantageous because the configuration allows the lower portion 116, 136 to be easily opened to allow a diaper to be changed or to take a rectal temperature. For example, when tabs 166, 168 are removably attached to complementary tab 170, the lower portion 136 of the front panel 122 can be open, allowing access to the infant near the infant's feet or bottom. The size of the opening can be further increased by sliding the zipper 140 along the second side 32 of the infant or toddler 10. For example, when tabs 166, 168 are removably attached to complementary tab 170, the lower portion 136 of the front panel 122 can be open allowing the infant or toddler 10 to stand or crawl. For example, when tabs 166, 168 are removably attached to complementary tab 170, the lower portion 136 of the front panel 122 can be open allowing even more freedom of movement of the hips 26 and legs 28. If desired, to close access through the lower portion 116, 136, the zipper 140 can slide along the closable edges 118, 138. The zipper 140 can be placed in the zipper garage 142 to prevent inadvertent unzipping of the zipper 140.

The sleep sack 100 opens to lie substantially flat. The sleep sack 100 is intuitive to use. The arm holes 144, 164 provide a visual cue to the user of the sleep sack 100. Once the front panel 122 is folded over the back panel 102, the closeable edges 118, 138 align. The closable edges 118, 138 provide a visual cue to the user to use the zipper 140. The zipper garages 142 provide a visual cue to slide the zipper entirely along the closeable edge 118, 138. The flap 152 is smaller than the front panel 122. The size and shape of the flap 152 provide a visual cue to fold the front panel 122 before securing the flap 152. The different types of attachment means provide a visual cue to the user. The closeable edges 118, 138 mate to align the front panel 122 and the back panel 102. The tabs 166, 168 and the complementary tab 170 mate to align the flap 152 to the back panel 102. The infant or toddler 10 faces the user during use. The sleep sack 100 can have familiar features to robes or other garments such as arm holes 144, 164.

The materials are moisture wicking, which can reduce excess heat, and thus the possibility of the infant or toddler 10 can overheat. The material can keep the skin of the infant or toddler 10 dry. A non-limiting example of the material comprises polyester fibers. In some embodiments, the polyester fibers are uncoated so that the moisture-wicking property of the materials is substantially mechanical. Specifically, the moisture-wicking property of the material is due substantially to one or more of twist of the polyester fibers, sizes of gaps formed in a woven pattern of the polyester fibers, or how the fibers are woven. Wicking occurs when fibers channel moisture along the gaps through capillary action, pulling the moisture to the fabric surface facing away from the infant or toddler 10 to promote evaporation at the surface.

In some embodiments, a surface drying time of the material of the sleep sack 100 can be measured. Under controlled temperature, humidity, and wind condition, distilled water drops can be placed on the material. A surface drying time of the material of the sleep sack 100 can be measured from a time point when the distilled water is dropped onto the material to a time point when the surface of the fabric is dry. For example, a piece of tissue with water-absorbing property can be pressed onto a surface of the material of the sleep sack 100 periodically to determine if the surface of the material is dry. The surface of the material is dry when the piece of tissue no longer absorbs any moisture.

In some embodiments, when the room temperature is between about 70 to about 80 degrees Fahrenheit (about 21 to about 27 degrees Celsius) and the relative humidity is between 30% and 70%, a piece of the fabric of the sleep sack 100 (for example, with a surface area are of about 4"×4" (about 10 cm×10 cm)) can dry in less than about 50 seconds after having absorbed about 2-5 ml of liquid. In some embodiments, under similar room temperature and relative humidity, the same piece of fabric can dry in less than about 40 seconds after having absorbed about 2-5 ml of liquid.

In another embodiment, the woven material of the sleep sack 100 that has moisture wicking capabilities that are substantially mechanical in nature can also be treated with one or more chemicals to prevent moisture from soaking into the fabric to further enhance the moisture-wicking property of the fabric. In this embodiment, the material has both mechanical and chemical moisture-wicking properties.

In addition, the materials of the sleep sack 100 allow for small movements of the infant or toddler 10 inside the sleep sack 100 when the swaddling is maintained in place on the infant or toddler 10. In some embodiments, the woven material can include both fibers to provide rapid moisture-wicking and spandex (sold under the trademark LYCRA® or other brand names) to provide stretchability to the fabric.

The tabs 166, 168 can substantially rectangular in shape. The first tab 166 can have a longer vertical side. The first tab 166 being substantially aligned with the second side 32 of the infant or toddler 10. The first tab 166 can have the longer vertical side being substantially aligned with the vertical or substantially vertical portion of the flap 152. The second tab can have a longer horizontal side being substantially aligned with the second side 32 of the infant or toddler 10. The second tab 168 can have the longer horizontal side being substantially aligned with the sloped portion of the flap 152. The complementary tab 170 can have a longer vertical side. The complementary tab 170 being substantially aligned with the first side 30 of the infant or toddler 10. The complementary tab 170 can be on the outer surface 126 of the front panel 122. The complementary tab 170 can be on the outer surface 106 of the back panel 102.

In some embodiments, the shorter side of the tabs 166, 168 can have a length of at least about 0.5 inch. In some embodiments, the shorter side of the tabs 166, 168 can have a length of at least about 1 inch. In other embodiments, the shorter side of the tabs 166, 168 can have a length of at least about 2 inches. The longer side of the tabs 166, 168 can be a few times longer than the shorter side of the tabs 166, 168. For example, the longer side of the tabs 166, 168 can be about 2 times to 8 times the length of the shorter side of the tabs 166, 168. In some embodiments, the longer side of the tabs 166, 168 can have a length of at least about 1 inch. In other embodiments, the longer side can have a length of at least about 2 inches. In other embodiments, the longer side can have a length of at least about 4 inches. In one embodiment, the tabs 166, 168 can have a dimension of about 2 inches by 4 inches.

In some embodiments, the shorter side of the complementary tab 170 can have a length of at least about 2 inches. In other embodiments, the shorter side of the complementary tab 170 can have a length of at least about 3 inches. The longer side of the complementary tab 170 can be a few times longer than the shorter side of the complementary tab 170. For example, the longer side of the complementary tab 170 can be about 2 times to 8 times the length of the shorter side of the complementary tab 170. In some embodiments, the longer side of the complementary tab 170 can have a length of at least about 4 inches. In other embodiments, the longer side can have a length of at least about 6 inches. In other embodiments, the longer side can have a length of at least about 8 inches. In one embodiment, the tabs 166, 168 can have a dimension of about 4 inches by 8 inches.

This configuration advantageously allow the tightness of the sleep sack 100 to be adjustable depending on infant and toddler sizes, and allowing the same sleep sack to be used throughout different stages of the growth of the infant or toddler without having to upgrade to a larger-sized sleep sack. A skilled artisan will recognize that each tab and complementary tab can be of different sizes and a variety of size, shape, and/or number can be used without departure from the scope of this disclosure.

Figure 9:
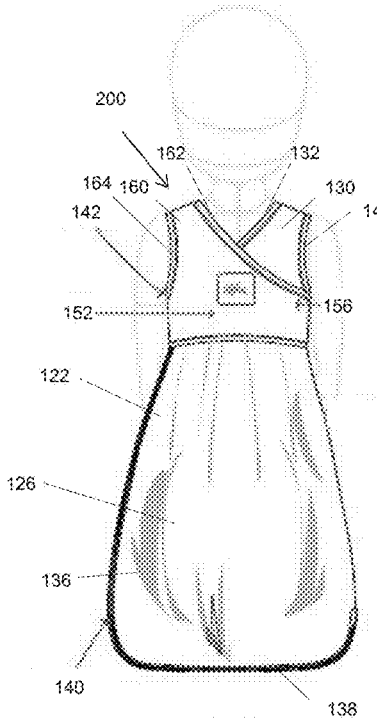
FIG. 9 is a front view of a sleep sack.
Figure 10:
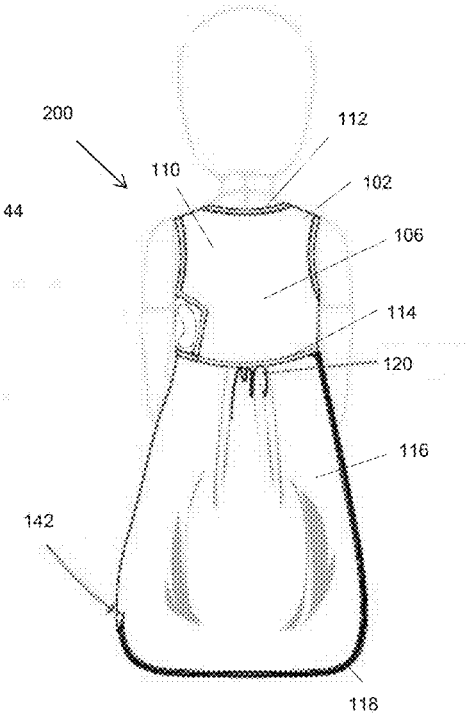
FIG. 10 is a back view of the sleep sack of FIG. 9.
Figure 11:
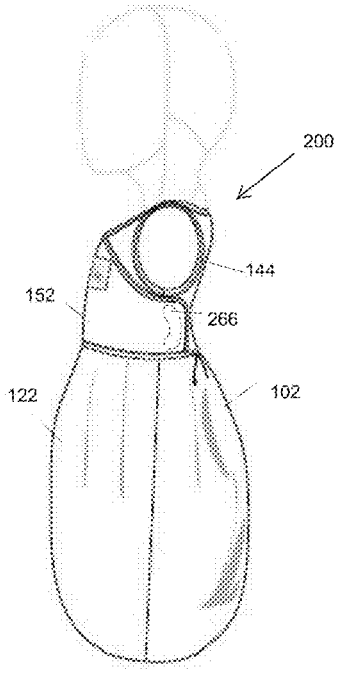
FIG. 11 is a first side view of the sleep sack of FIG. 9.
Figure 12:
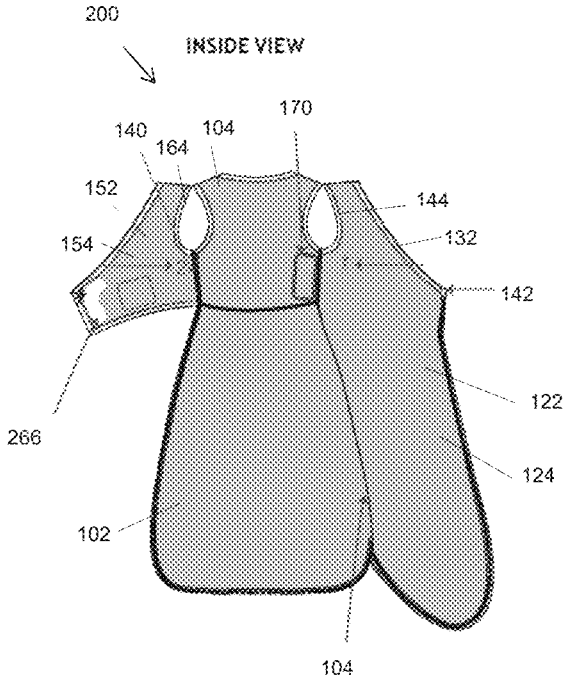
FIG. 12 is an inside view in a method of use of the sleep sack of FIG. 9.

FIG. 9 illustrates a front view of a sleep sack 200. FIG. 10 illustrates a back view of the sleep sack 200. FIG. 11 illustrates a first side view of the sleep sack 200. FIG. 12 illustrates an inside side view of the sleep sack 200. The sleep sack 200 can include any of the features of sleep sack 100. The sleep sack 200 is designed to maintain compression on a chest of an infant or toddler, while allowing movement of the hips. The sleep sack 200 can have any of the advantages described herein. The sleep sack 200 can be designed with moisture-wicking fabric. The material can includes any of the features described herein.

The sleep sack 200 can include a back panel 102. The back panel 102 can comprise an inner surface 104 and an outer surface 106. The back panel 102 can comprise an upper portion 110. The upper portion 110 can include an upper edge 112. The upper portion 110 can include a lower seam 114. The back panel 102 can comprise a lower portion 116. The back panel 102 can include a closable edge 118. The back panel 102 can include gathers 120. The sleep sack 200 can include a front panel 122. The front panel 122 can comprise an inner surface 124 and an outer surface 126.

The front panel 122 can comprise an upper portion 130. The upper portion 130 can include an upper edge 132. The upper edge 132 can taper downward. The front panel 122 can comprise a lower portion 136. The front panel 122 can include a closable edge 138. The front panel 122 and the back panel 102 can be reversibly secured. The zipper 140 can secure the closable edge 138 of the front panel 122 and the closable edge 118 of the back panel 102. The sleep sack 200 can include one or more zipper garage 142. The zipper garage 142 can be located near the feet of the infant. The zipper garage 142 can have a length to cover the pull of the zipper 140. The zipper garage 142 near the bottom near the feet can be deeper. The zipper garage 142 can be deep to help ensure infants with their developing fine motor skills are not be able to unzip the sleep sack 200. The zipper garage 142 can be longer than the pull of the zipper 140. The zipper pull 140 can be fully nested in the zipper garage 142 to secure the zipper 140. The back panel 102 and the front panel 122 can form an arm hole 144. The back panel 102 and the front panel 122 can cover only one shoulder of the infant or toddler.

The sleep sack 200 can include a flap 152. The flap 152 can comprise an inner surface 154 and an outer surface 156. The flap 152 can comprise an upper portion 160. The upper portion 160 can include an upper edge 162. The upper edge 162 can taper downward. The upper portion 160 can be near the upper front or torso of the infant or toddler. The upper portion 160 can be adjacent to the chest of the infant or toddler. The upper portion 160 can be above the waist of the infant or toddler. The upper portion 160 can be above the hips of the infant or toddler. The back panel 102 and the flap 152 can form an arm hole 164. The flap 152 can be designed to cover only a portion of the chest or torso. The upper portion 160 of the flap 152 substantially overlaps with the upper portion 130 of the front panel 122. The upper portion 160 of the flap 152 and the upper portion 130 of the front panel 122 form a cross-over pattern.

The sleep sack 200 is designed with hook and loop fasteners, or Velcro®. The flap 152 can include a singular tab of hook and loop fastener 266. The tab of hook and loop fastener 266 can be in the shape of a boomerang. The tab of hook and loop fastener 266 can comprise two arms connected at an angle. The tab of hook and loop fastener 266 can comprise an angle between 80 degrees and 120 degrees. The tab of hook and loop fastener 266 can include a bend. The tab of hook and loop fastener 266 can include a curve. The tab of hook and loop fastener 266 can include two connected sections. The tab of hook and loop fastener 266 can include a vertically or generally vertically oriented section. The tab of hook and loop fastener 266 can include a horizontally or generally horizontally oriented section. The tab of hook and loop fastener 266 can include sections that are be skewed or non-parallel. The tab of hook and loop fastener 266 can include sections that are offset. The tab of hook and loop fastener 266 can include sections that are oriented to account for different pull-off forces. The tab of hook and loop fastener 266 can include a section that counteracts forces in a first direction. The tab of hook and loop fastener 266 can include a section that counteracts forces in a second direction, wherein the first direction and the second direction are different.

The sleep sack 200 can include a singular complementary tab 170. The singular complementary tab 170 can be located on the back panel 102. The singular complementary tab 170 can be located on the front panel 122. The singular complementary tab 170 can be located between the front panel 122 and the back panel 102. The tab of hook and loop fastener 266 and the complementary tab 170 can have different shapes. The complementary tab 170 can be generally rectangular. The tab of hook and loop fastener 266 can be generally boomerang shaped. The complementary tab 170 can have a greater length than the tab of hook and loop fastener 266. In other embodiments, the complementary tab 170 and the tab of hook and loop fastener 266 can have about the same length. The complementary tab 170 can have a greater width than the tab of hook and loop fastener 266. In other embodiments, the complementary tab 170 and the tab of hook and loop fastener 266 can have about the same width. The complementary tab 170 can have a greater surface area than the tab of hook and loop fastener 266.

The tab of hook and loop fastener 266 can be secured to the complementary tab 170. The complementary tab 170 can be shaped and sized to allow the tab of hook and loop fastener 266 to be secured at any of a variety of locations on the complementary tab 170. The complementary tab 170 can be shaped and sized to accommodate different compression levels based on the positioning of the tab of hook and loop fastener 266. The complementary tab 170 can be shaped and sized to accommodate growth of the infant or toddler based on the positioning of the tab of hook and loop fastener 266. The complementary tab 170 can be shaped and sized to accommodate variations in chest dimensions of infants or toddler based on the positioning of the tab of hook and loop fastener 266.

The tab of hook and loop fastener 266 can include hook fabric and the complementary tab 170 can include loop fabric. In other embodiments, the tab of hook and loop fastener 266 can include loop fabric and the complementary tab 170 can include hook fabric.

The upper edge 132 of the front panel 122 and the upper edge 162 of the flap 152 are angled downward from the shoulder seams, each in opposite directions. The lower edge the flap 152 can be horizontal or generally horizontal. The flap 152 can include a vertical or generally vertical side edge. The tab of hook and loop fastener 266 can extend along the upper edge 162 of the flap 152. The tab of hook and loop fastener 266 can extend along the vertical side edge of the flap 152.

Figure 13:
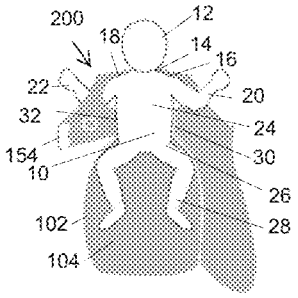
FIG. 13 is a first view in a method of use of the sleep sack of FIG. 9.
Figure 14:
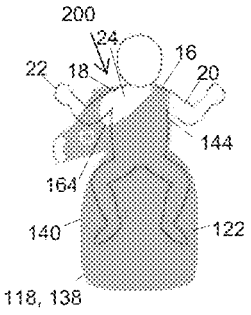
FIG. 14 is a second view in a method of use of the sleep sack of FIG. 9.
Figure 15:
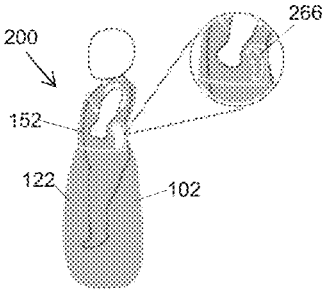
FIG. 15 is a third view in a method of use of the sleep sack of FIG. 9.
Figure 16:
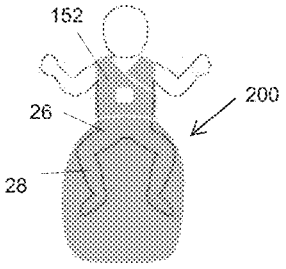
FIG. 16 is a fourth view in a method of use of the sleep sack of FIG. 9.

FIG. 13 illustrates a first view in a method of use of the sleep sack 200. FIG. 14 illustrates a second view in a method of use of the sleep sack 200. FIG. 15 illustrates a third view in a method of use of the sleep sack. FIG. 16 illustrates a fourth view in a method of use of the sleep sack.

The method can comprise placing the back panel 102 against a surface such that the inner surface 104 is facing toward the infant or toddler 10. The infant or toddler 10 has a head 12, a neck 14, a first shoulder 16, a second shoulder 18, a first arm 20, and a second arm 22. The infant or toddler 10 has a torso 24, hips 26, and legs 28. The infant or toddler 10 has a first side 30 of the body and a second side 32 of the body. The method can comprise placing the first arm 20 of the infant or toddler 10 through the first arm hole 144. The method can comprise placing the second arm 22 of the infant or toddler 10 through the second arm hole 164. The shoulder seams can be positioned over the shoulders 16, 18 of the infant or toddler 10.

The method can comprise wrapping the front panel 122 over the front of the infant or toddler 10. The lower portion 136 of the front panel 122 and the lower portion 116 of the back panel 102 can align the closable edges 118, 138 along the lower portions 116, 136. The upper portion 130 of the front panel 122 and the upper portion 110 of the back panel 102 can align the closable edges 118, 138 along the upper portions 110, 130. The zipper 140 can slide along the closable edges 118, 138. The zipper 140 can be tucked into the zipper garage 142 near the second arm hole 164. The zipper 140 can be tucked into the zipper garage 142 near the feet of the infant 10. The zipper 140 can be a two-way zipper. The method can comprise covering only one shoulder with the front panel 122. The front panel 122 can be releaseably secured under the second arm hole 164.

The method can comprise wrapping the flap 152 over the front of the infant or toddler 10. The flap 152 can overlie the upper portion 130 of the front panel 122 after the front panel 122 is secured along the closeable edge 118, 138. The method can comprise covering only one shoulder with the flap 152. The method can comprise covering the shoulder 18 of the second arm 22 with the flap 152. The flap 152 can be secured with the tab of hook and loop fastener 266 and the complementary tab 170. The flap 152 forms a one-shoulder design. The flap 152 extends diagonally across the torso 24 of the infant or toddler 10. The flap 152 can be releaseably secured under the first arm hole 144. The flap 152 can be secured to an outer surface of the sleep sack 200. The flap 152 can be secured by attaching hook and loop fabric.

The inner surface 154 of the flap 152 can include the tab of hook and loop fastener 266. The outer surface of the sleep sack 200 can include the complementary tab 170. The complementary tab 170 can be located on the outer surface 104 of the back panel 102. The complementary tab 170 can be located on the outer surface 124 of the front panel 122. The tab of hook and loop fastener 266 and the complementary tab 170 can comprise hook and loop fasteners. The flap 152 forms a one-shoulder design.

The flap 152 applies a compressive force. The flap 152 can snuggly contact with the torso 24 of the infant or toddler 10. The flap 152 can be stretched against the torso 24. The flap 152 can apply compression depending on the connection between tab of hook and loop fastener 266 and the complementary tab 170. The tab of hook and loop fastener 266 can be at a first position on the complementary tab 170 to apply a slight compressive force on the torso 24 of the infant or toddler 10. The tab of hook and loop fastener 266 can be at a second position on the complementary tab 170 to apply a medium compressive force on the torso 24 of the infant or toddler 10. The tab of hook and loop fastener 266 can be at a third position on the complementary tab 170 to apply a strong compressive force on the torso 24 of the infant or toddler 10. The first position, the second position, and the third position can be laterally aligned along the complementary tab 170. The complementary tab 170 can have a large surface area to accommodate different positions of the tab of hook and loop fastener 266. In some embodiments, the tab of hook and loop fastener 266 is hook fabric. The complementary tab 170 can be loop fabric. The method can comprises adjusting the compression by repositioning the tab of hook and loop fastener 266.

The flap 152 creates a snug fit around the torso 24 of the infant or toddler 10. The inventive cross-over design allows compression to be selectively applied. The sleep sack 200 allows a loose fit around the hips 26 and the legs 28. The closeable edge 118, 138 can be opened to allow the infant or toddler 10 to stand while within the sleep sack 200. The closeable edge 118, 138 can be opened without releasing the compression from the flap 152. The closeable edge 118, 138 can be independently opened and closed from the flap 152. The closeable edges 118, 138 and the flap 152 are separately secured.

The sleep sack 200 can be advantageous because the configuration allows the flap 152 to be adjusted to accommodate growth and to accommodate different sized infants and toddlers. The tab of hook and loop fastener 266 allows adjustment of the flap 152 in the lateral direction. The tab of hook and loop fastener 266 allows adjustment of the flap 152 in the vertical direction. After the front panel 122 is secured to the back panel 102, the tab of hook and loop fastener 266 will face the complementary tab 170 once folded over the torso 24 of the infant or toddler 10. Certain embodiments include the complementary tab 170 having a larger surface area to improve the adjustability of the flap 152. The example embodiment comprises one tab of hook and loop fastener 266 and one complementary tab 170, but other configurations are contemplated.

The configuration of the sleep sack 200 can advantageously focus on safety and the design performing in a manner intended by the sleep sack. The configuration of the sleep sack 200 can advantageously prevent or limit the corners of the hook and loop fabric from rolling back. The configuration of the sleep sack 200 can advantageously prevent or limit the hook and loop fabric from curling. The tab of hook and loop fastener 266 can be shaped to prevent or limit the curling or rolling of the edges or corners of the hook and loop fabric. The tab of hook and loop fastener 266 can be shaped to maintain its position on the flap 152. The tab of hook and loop fastener 266 can be designed to align with a tapered edge and a vertical edge of the flap 152. The tab of hook and loop fastener 266 can be designed to align with the edges of the flap 152. The tab of hook and loop fastener 266 can be designed to hold extremely well. The tab of hook and loop fastener 266 can be designed to apply significant compression on the torso. The tab of hook and loop fastener 266 can hold during movements of the toddler or infant 10. The tab of hook and loop fastener 266 can counteract forces in two or more directions. The tab of hook and loop fastener 266 can securely attach to the complementary tab 170. The tab of hook and loop fastener 266 is designed to hold firmly. The tab of hook and loop fastener 266 can securely attach to the complementary tab 170 are designed to wrap around the torso.

The tab of hook and loop fastener 266 can securely attach to the complementary tab 170 to prevent or limit potential exposure for skin to rub against the tabs 266, 170. The complementary tab 170 can be positioned on the back of the infant. The tab of hook and loop fastener 266 can securely attach to near the back of the infant. The location of the attachment of the tab of hook and loop fastener 266 and the complementary tab 170 can prevent or limit potential exposure for skin to rub against the tabs 266, 170. The complementary tab 170 can be larger in surface area. The complementary tab 170 can be exposed to the infant. The complementary tab 170 can be loop fabric to be softer to the touch. The tab of hook and loop fastener 266 can be hook fabric. The hook fabric can be fully engaged with the complementary tab 170 during methods of use, in some embodiments. The tab of hook and loop fastener 266 can face inward toward the infant. The design of the tab of hook and loop fastener 266 can prevent or limit contact with hook fabric. The tab of hook and loop fastener 266 can be fully covered by the flap 152 in use. The hook fabric can be fully covered by the flap 152 in use.

The configuration of the sleep sack 200 can advantageously reduce movement of the sleep sack 200 in the area near the infant or toddler's head and thereby reduce the possibility of unsafe bunching of the sleep sack 200 around the infant or toddler's neck or mouth. The over shoulder design can prevent migration of the sleep sack 200. The compression of the flap 152 around the torso 24 can prevent migration of the sleep sack 200.

The front panel 122 and the flap 152 create an inventive cross-over pattern. The upper portion 160 of the flap 152 includes a sloped section. At least a portion of the tab of hook and loop fastener 266 is positioned along the second sloped section of the flap 152. The upper portion 160 of the flap 152 includes a vertical or substantially vertical section. At least a portion of the tab of hook and loop fastener 266 is positioned along the vertical or substantially vertical section of the flap 152. In some embodiments, the flap 152 only covers the torso or chest of the infant. The flap 152 does not cover the hips or legs of the infant. The flap 152 applies a compressive force above the waist the infant. The flap 152 does not apply a compressive force below the waist of the infant. The flap 152 is designed to constrain only the torso or chest of the infant. The flap 152 does not constrain the hips or legs of the infant. The front panel 122 and the flap 152 create a v-shaped opening for the neck and head of the infant. The front panel 122 and the flap 152 are positioned below the chin of the infant. The front panel 122 extends diagonally from the shoulder to beneath the arm hole. The flap 152 extends diagonally from the shoulder to beneath the arm hole.

The flap 152 can include a single tab of hook and loop fastener 266 and a single complementary tab 170. In some embodiments, the maximum width of the complementary tab 170 is at least 1 (or at least about 1), at least 1.5 (or at least about 1.5), at least 2 (or at least about 2), at least 2.5 (or at least about 2.5), at least 3 (or at least about 3) times wider than the maximum width of the tab of hook and loop fastener 266. For example, the maximum width of the complementary tab 170 can be 6 in (or about 6 in) (15 cm (or about 15 cm)). The maximum width of the tab of hook and loop fastener 266 can be 4 in (or about 1.5 in) (10 cm (or about 10 cm)). In some embodiments, the maximum vertical length of the complementary tab 170 is at least 1 (or at least about 1), at least 1.5 (or at least about 1.5), at least 2 (or at least about 2), at least 2.5 (or at least about 2.5), at least 3 (or at least about 3) times longer than the maximum vertical length of the tab of hook and loop fastener 266. For example, the maximum vertical length of the complementary tab 170 can be 6 in (or about 6 in) (15 cm (or about 15 cm)). The maximum vertical length of a member of the tab of hook and loop fastener 266 can be 4 in (or about 1.5 in) (10 cm (or about 10 cm)).

The surface area of the complementary tab 170 at least 1 (or at least about 1), at least 1.5 (or at least about 1.5), at least 2 (or at least about 2), at least 2.5 (or at least about 2.5), at least 3 (or at least about 3) times greater than the surface area of tab of hook and loop fastener 266. For example, the surface area of the complementary tab 170 can be 18 $in^2$ (or about 18 $in^2$) (116 $cm^2$ (or about 116 $cm^2$)). The surface area of the tab of hook and loop fastener 266 can be 9 $in^2$ (or about 9 $in^2$) (58 $cm^2$ (or about 58 $cm^2$)). The foregoing dimensions are provided as examples of suitable configurations. Other dimensions are possible and are within the scope of the disclosure.

The configuration can be advantageous because the configuration allows the lower portion 116, 136 to be easily opened without changing the compression of the torso. For example, when the tab of hook and loop fastener 266 is removably attached to complementary tab 170, the lower portion 136 of the front panel 122 can be open, allowing access to the infant near the infant's feet or bottom. The size of the opening can be further increased by sliding the zipper 140 along the second side 32 of the infant or toddler 10. For example, when the tab of hook and loop fastener 266 is removably attached to complementary tab 170, the lower portion 136 of the front panel 122 can be open allowing the infant or toddler 10 to stand or crawl. For example, when the tab of hook and loop fastener 266 is removably attached to complementary tab 170, the lower portion 136 of the front panel 122 can be open allowing even more freedom of movement of the hips 26 and legs 28. If desired, to close access through the lower portion 116, 136, the zipper 140 can slide along the closable edges 118, 138. The zipper 140 can be placed in the zipper garage 142 to prevent inadvertent unzipping of the zipper 140. The zipper garage 142 can be deep to fully house the pull of the zipper 140.

The tab of hook and loop fastener 266 can be boomerang shaped. The tab of hook and loop fastener 266 can be substantially L-shaped. The tab of hook and loop fastener 266 can be substantially J-shaped. The tab of hook and loop fastener 266 can be substantially V-shaped. The tab of hook and loop fastener 266 can be substantially C-shaped. The tab of hook and loop fastener 266 can have two arms having the same length. The tab of hook and loop fastener 266 can have two arms having different lengths. The tab of hook and loop fastener 266 can have a portion aligned with the second side 32 of the infant or toddler 10. The tab of hook and loop fastener 266 can have a portion substantially aligned with the vertical or substantially vertical portion of the flap 152. The tab of hook and loop fastener 266 can have a portion substantially aligned with the sloped portion of the flap 152. The complementary tab 170 can have a longer length than the tab of hook and loop fastener 266. The complementary tab 170 can have a longer width than the tab of hook and loop fastener 266. The complementary tab 170 can be substantially aligned with the first side 30 of the infant or toddler 10. The complementary tab 170 can be on the outer surface of the sleep sack 200.

In some embodiments, the tab of hook and loop fastener 266 can have a length of 0.5 inch, 1 inch, 2 inches, 3 inches, 4 inches, 5 inches, 6 inches, 7 inches, 8 inches, at least about 0.5 inch, at least about 1 inch, at least about 2 inches, at least about 3 inches, at least about 4 inches, at least about 5 inches, at least about 6 inches, at least about 7 inches, at least about 8 inches, or any range of two of the foregoing values. In some embodiments, the tab of hook and loop fastener 266 can have a width of 0.5 inch, 1 inch, 2 inches, 3 inches, 4 inches, 5 inches, 6 inches, 7 inches, 8 inches, at least about 0.5 inch, at least about 1 inch, at least about 2 inches, at least about 3 inches, at least about 4 inches, at least about 5 inches, at least about 6 inches, at least about 7 inches, at least about 8 inches, or any range of two of the foregoing values.

In some embodiments, the complementary tab 170 can have a length of 0.5 inch, 1 inch, 2 inches, 3 inches, 4 inches, 5 inches, 6 inches, 7 inches, 8 inches, at least about 0.5 inch, at least about 1 inch, at least about 2 inches, at least about 3 inches, at least about 4 inches, at least about 5 inches, at least about 6 inches, at least about 7 inches, at least about 8 inches, or any range of two of the foregoing values. In some embodiments, the complementary tab 170 can have a width of 0.5 inch, 1 inch, 2 inches, 3 inches, 4 inches, 5 inches, 6 inches, 7 inches, 8 inches, at least about 0.5 inch, at least about 1 inch, at least about 2 inches, at least about 3 inches, at least about 4 inches, at least about 5 inches, at least about 6 inches, at least about 7 inches, at least about 8 inches, or any range of two of the foregoing values.

In some embodiments, a sleep sack is provided. The sleep sack can include a back panel made of a resilient, moisture-wicking material. In some embodiments, the back panel is configured to open to lay flat and defined by an outer surface that, when an infant or toddler is placed on the back panel, faces away from the infant or toddler and an inner surface that, when an infant is placed on the back panel, faces toward the infant or toddler. The sleep sack can include a front panel made of a resilient, moisture-wicking material. In some embodiments, the front panel extends from a first side of the back panel. In some embodiments, the front panel is defined by an outer surface and an inner surface. In some embodiments, the front panel and the back panel form a first arm hole. The sleep sack can include a flap made of a resilient, moisture-wicking material. In some embodiments, the flap extends from a second side of the back panel. In some embodiments, the flap is defined by an outer surface and an inner surface. In some embodiments, the flap and the back panel form a second arm hole. The sleep sack can include a zipper. In some embodiments, the back panel and the front panel comprise closable edges configured to be opened and closed by the zipper. In some embodiments, the inner surface of the flap comprises a first tab. In some embodiments, an outer surface of the back panel or the front panel comprises a complementary tab. In some embodiments, in use, the front panel covers a first shoulder of the infant or toddler and extends toward the second arm hole, and the flap covers a second shoulder of the infant or toddler and extends toward the first arm hole.

In some embodiments, the material comprises a blend of polyester fibers and spandex fibers. In some embodiments, the material is configured to move moisture away from the infant or toddler. In some embodiments, the first tab comprises a first hook or loop fabric element and the complementary tab comprises a second hook or loop fabric element. In some embodiments, the complementary tab element has a surface area at least about two times larger than the first hook or loop fabric element. In some embodiments, the closable edges extends along a bottom edge and at least one side edge. In some embodiments, the closable edges extends along a bottom edge and to the second arm hole. In some embodiments, the flap comprises a second tab. In some embodiments, the first tab has a first lateral spacing from an edge of the flap and the second tab has a second lateral spacing from the edge of the flap, the second lateral spacing greater than the first lateral spacing. In some embodiments, the first tab comprises a hook fabric element and the complementary tab comprises a loop fabric element. In some embodiments, the first tab is shaped like a boomerang. In some embodiments, the first tab is aligned along a tapered edge and a vertical edge. In some embodiments, the first tab consists of a single tab of hook and loop fabric and the complementary tab consists of a single tab of hook and loop fabric.

In some embodiments, a sleep sack is provided. The sleep sack can include a back panel defined by an outer surface that, when an infant or toddler is placed on the back panel, faces away from the infant or toddler and an inner surface that, when an infant is placed on the back panel, faces toward the infant or toddler. The sleep sack can include a front panel extending from a first side of the back panel, the front panel defined by an outer surface and an inner surface. In some embodiments, the front panel and the back panel form a first arm hole. The sleep sack can include a flap extending from a second side of the back panel. In some embodiments, the flap defined by an outer surface and an inner surface. In some embodiments, the flap and the back panel form a second arm hole. The sleep sack can include a first attachment configured to allow the front panel and the back panel to be releasably secured. The sleep sack can include a second attachment configured to allow the flap and an outer surface of the sleep sack to be releasably secured. In some embodiments, the flap is configured to apply compression on a torso of the infant or toddler when the second attachment is secured. In some embodiments, in use, the front panel covers a first shoulder of the infant or toddler without covering a second shoulder, and the flap covers the second shoulder of the infant or toddler without covering the first shoulder.

In some embodiments, the back panel, the front panel, and the flap comprise a moisture wicking material. In some embodiments, the back panel, the front panel, and the flap comprise a stretchable material. In some embodiments, the back panel, the front panel, and the flap comprise a polyester spandex blend. In some embodiments, the first attachment comprises a zipper. In some embodiments, the second attachment comprises hook or loop fabric. In some embodiments, the second attachment is positioned on the inner surface of the flap and the outer surface of the back panel. In some embodiments, the second attachment is positioned on the inner surface of the flap and the outer surface of the front panel. In some embodiments, the second attachment consists of two tabs of hook and loop fabric positioned on the inner surface of the flap and one complementary tab of hook and loop fabric the outer surface of the back panel. In some embodiments, the second attachment consists of one tab of hook and loop fabric positioned on the inner surface of the flap and one complementary tab of hook and loop fabric the outer surface of the back panel. In some embodiments, the second attachment comprises a tab of hook and loop fabric is shaped like a boomerang. In some embodiments, the front panel and the back panel comprise a closeable edge that extends to the second arm hole. In some embodiments, the flap and the front panel form a cross-over design. In some embodiments, the flap is configured to apply compression only to the torso of the infant or toddler.

The foregoing description of the invention includes preferred forms thereof. Modifications may be made thereto without departing from the scope of the invention. To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Through the description and the claims, the terms "comprises," "comprising," and the like are to be construed in an inclusive sense, that is, in the sense of "including but not limited to," unless the context clearly requires otherwise.

Although the invention has been described by way of example and with reference to possible embodiments thereof, it is to be understood that modifications or improvements may be made thereto without departing from the spirit and scope of the invention and without diminishing its attendant advantages. Furthermore, where reference has been made to specific components or integers of the invention having known equivalents, such equivalents are herein incorporated as if individually set forth.

Any discussion of the prior art throughout the specification should in no way be considered as an admission that such prior art is widely known or forms part of the common general knowledge in the field anywhere in the world.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

What is claimed is:

1. A sleep sack comprising:

a back panel comprising an outer surface that, when an infant or toddler is placed on the back panel, faces away from the infant or toddler, wherein the back panel comprises an inner surface that, when an infant is placed on the back panel, faces toward the infant or toddler, a front panel extending from a first side of the back panel, wherein the front panel comprises an outer surface and an inner surface, wherein the front panel and the back panel form a first arm hole to receive a first arm of the infant or toddler, in use, a flap extending from a second side of the back panel, wherein the flap comprises an outer surface and an inner surface, wherein the flap and the back panel form a second arm hole to receive a second arm of the infant or toddler, in use, a zipper, wherein the back panel and the front panel comprise closable edges configured to be opened and closed by the zipper, wherein the zipper ends at the second arm hole, wherein the flap extends below where the zipper ends, wherein, in use, the front panel covers a first shoulder of the first arm and the flap covers a second shoulder of the second arm of the infant or toddler.

2. The sleep sack of claim 1, wherein the front panel crosses diagonally over a chest of the infant or toddler, in use.

3. The sleep sack of claim 1, wherein an upper edge of the front panel extends from the first shoulder to under the second arm, in use.

4. The sleep sack of claim 1, wherein the front panel extends below the second shoulder, in use.

5. The sleep sack of claim 1, wherein the back panel and the front panel are opened and closed by the zipper along a bottom edge and at least one side edge.

6. The sleep sack of claim 1, wherein the sleep sack comprises a moisture-wicking material.

7. The sleep sack of claim 1, wherein the flap crosses diagonally over a chest of the infant or toddler, in use.

8. The sleep sack of claim 1, wherein the flap is above a waist of the infant or toddler, in use.

9. The sleep sack of claim 1, wherein an upper edge of the flap extends from the second shoulder to under the first arm, in use.

10. The sleep sack of claim 1, wherein the flap extends below the first shoulder, in use.

11. The sleep sack of claim 1, wherein the flap is configured to be reversibly secured with hook and loop fabric.

12. The sleep sack of claim 1, wherein the inner surface of the flap comprises an attachment tab in a shape of a boomerang.

13. The sleep sack of claim 1, wherein the flap and an upper portion of the front panel form a cross-over pattern.

14. A sleep sack comprising:

a back panel comprising an outer surface that, when an infant or toddler is placed on the back panel, faces away from the infant or toddler, wherein the back panel comprises an inner surface that, when an infant is placed on the back panel, faces toward the infant or toddler, a front panel extending from the back panel, wherein the front panel comprises an outer surface and an inner surface, wherein the front panel and the back panel form a first arm hole to receive a first arm of the infant or toddler, in use, a flap extending from the back panel, wherein the flap comprises an outer surface and an inner surface, wherein the flap and the back panel form a second arm hole to receive a second arm of the infant or toddler, in use, wherein the inner surface of the flap comprises a first attachment, wherein the front panel covers a first shoulder of the first arm of the infant or toddler, in use, wherein an upper edge of the front panel extends from the first shoulder to under the second arm, in use, wherein the flap covers a second shoulder of the second arm of the infant or toddler, in use, wherein an upper edge of the flap extends from the second shoulder to under the first arm, in use, a second attachment configured to allow the flap to be releasably secured, wherein the flap is configured to apply compression on a torso of the infant or toddler when the attachment is secured, wherein the second attachment comprises a greater surface area than the first attachment to allow the flap to be releasably secured over a range of positions to allow adjusting of the compression on the torso of the infant or toddler.

15. The sleep sack of claim 14, wherein the sleep sack comprises a moisture wicking material.

16. The sleep sack of claim 14, wherein the attachment comprises hook and loop fabric.

17. The sleep sack of claim 14, wherein the attachment is in a shape of a boomerang.

18. The sleep sack of claim 14, wherein the flap and the front panel form a cross-over design.

19. The sleep sack of claim 14, wherein the flap is above hips of the infant or toddler, in use.

20. The sleep sack of claim 14, wherein the flap is configured to be reversibly secured along one side of the infant or toddler, in use.

* * * * *